US008952856B2

(12) United States Patent
Akiba et al.

(10) Patent No.: US 8,952,856 B2
(45) Date of Patent: Feb. 10, 2015

(54) TRANSMISSION/RECEPTION ELEMENT FOR SWITCHING RADIATION FREQUENCY

(75) Inventors: Akira Akiba, Kanagawa (JP); Koichi Ikeda, Kanagawa (JP)

(73) Assignee: SonyCorporation, Tokyo (JP)

( * ) Notice: Subject to any disclaimer, the term of this patent is extended or adjusted under 35 U.S.C. 154(b) by 854 days.

(21) Appl. No.: 12/929,273

(22) Filed: Jan. 12, 2011

(65) Prior Publication Data

US 2011/0187617 A1 Aug. 4, 2011

(30) Foreign Application Priority Data

Feb. 1, 2010 (JP) ..... 2010-020371

(51) Int. Cl.
*H01Q 9/00* (2006.01)

(52) U.S. Cl.
CPC ..... *H01Q 9/00* (2013.01)
USPC ..... 343/749; 343/700 MS; 343/909; 343/853; 343/723; 343/702

(58) Field of Classification Search
USPC ..... 343/749, 700 MS, 723, 909, 853, 702
IPC ..... H01Q 9/00
See application file for complete search history.

(56) References Cited

U.S. PATENT DOCUMENTS

| | | | | |
|---|---|---|---|---|
| 5,512,911 | A * | 4/1996 | Oprea | 343/700 MS |
| 6,789,315 | B2 * | 9/2004 | Marques et al. | 29/889.1 |
| 7,151,506 | B2 * | 12/2006 | Knowles et al. | 343/909 |
| 2004/0027029 | A1 * | 2/2004 | Borwick et al. | 310/309 |
| 2008/0042915 | A1 * | 2/2008 | Schillmeier et al. | 343/745 |
| 2009/0207091 | A1 * | 8/2009 | Anagnostou et al. | 343/876 |

OTHER PUBLICATIONS

H. K. Pan et al., "Reconfigurable Antenna Implementation in Multi-radio Platform," (Intel Corporation, University of Illinois at Urbana-Champaign), IEEE, 2008.

* cited by examiner

*Primary Examiner* — Sue A Purvis
*Assistant Examiner* — Jae Kim
(74) *Attorney, Agent, or Firm* — Sony Corporation

(57) ABSTRACT

A transmission/reception element includes: a plurality of metal layers each disposed with space from another; and a switch for controlling electrical coupling between the metal layers. The switch includes a contact-point group including a plurality of contact-point pairs each disposed in parallel between each two of the metal layers, and a drive section mechanically driving the contact-point group for state change of each of the contact-point pairs between in-contact and no-contact.

14 Claims, 20 Drawing Sheets

TRANSMISSION/RECEPTION ELEMENT FOR SWITCHING RADIATION FREQUENCY

BACKGROUND OF THE INVENTION

1. Field of the Invention

The present invention relates to a transmission/reception element suitable for use as an antenna with which the frequency characteristics can be changed with switch control.

2. Description of the Related Art

In recent years, a transmission/reception circuit is expected to cover a wider range of frequencies and to be ready for diversity and beamforming. Such an expectation thus leads to the increase of the number of antennas for a parallel arrangement. However, since the antenna is a component large in size occupying a large part of the area in the transmission/reception circuit, a larger number of antennas mean a much larger circuit area, and this is not considered desirable. To solve such a problem, an antenna called reconfigurable antenna has been under development. This reconfigurable antenna is provided with a plurality of metal patterns on a dielectric layer each for use as a radiation section (emission/propagation section), for example. These metal patterns are controlled in terms of their electrical coupling by a switch so that the radiation sections can be changed in electrical length.

Such a reconfigurable antenna mainly includes two types, one is the type with which the frequency (radiation frequency) can be controlled through arbitrary switching, and the other is the type with which the antenna directivity can be arbitrarily controlled. The antenna of the type with which the frequency is controlled through switching is described in US2009-0207091, for example, and such an antenna radiates electromagnetic waves at the frequency corresponding to the electrical length of the radiation sections. Generally, antennas radiate electromagnetic waves of frequencies being integral multiples of the base frequency (ω), i.e., ω, 2ω, 3ω, and others, with any one specific electrical length. On the other hand, as is capable of changing the electrical length through switch control, the reconfigurable antenna singly can transmit and receive electromagnetic waves of any frequencies not being integral multiples of each other. This accordingly helps to reduce the size of space needed for placement of antenna.

As an example, "Reconfigurable Antenna Implementation in Multi-radio Platform", Helen K. Pan, et al. (Intel Corporation, University of Illinois at Urbana-Champaign) describes a reconfigurable antenna being a monopole antenna partially provided with a MOSFET (Metal Oxide Semiconductor Field-Effect Transistor) switch. This reconfigurable antenna can be changed in state in response to a control signal coming from the outside, i.e., can be changed between a state 1 (at the frequencies of 0.8 GHz, 0.9 GHz, and 2.4 GHz), and a state 2 (at the frequencies of 1.8 GHz, 1.9 GHz, 2.1 GHz, and 5.0 GHz). Herein, in the state 1, the frequencies of 0.8 GHz and 0.9 GHz are not integral multiples of each other. This is because the reconfigurable antenna is designed to have a wide range of resonance frequencies, and any close frequencies are covered by one resonance frequency.

SUMMARY OF THE INVENTION

The issue here is that with the reconfigurable antenna as described above, each of the metal patterns is provided so as to have space with another for placement purpose of a switch. Such spaces resultantly cause a problem of narrowing the band with radiation characteristics when the metal patterns become conducting, and the resulting patterns of radiation are distorted. There is another problem of decreasing the antenna directivity due to the radiation of electromagnetic waves from a drive circuit including wiring patterns for switch control use. For not causing such problems, there may be a design idea of placing the switches themselves outside of the metal patterns, but this configuration does not yet solve the problem of influence to be exerted by the spaces between the metal patterns as described above. Considering the fact that the antenna directivity is decreased if the switches are placed far too off, the switches may be each disposed in proximity to each end of the corresponding space portion. This configuration, however, does not yet solve the problem of influence by the spaces between the metal patterns described above, and further, the drive circuit for the switches is increased in number.

It is thus desirable to provide a transmission/reception element that is capable of frequency switching among a plurality of patterns while being able to retain satisfactorily the radiation characteristics.

A transmission/reception element in an aspect of the invention is provided with a plurality of metal layers each disposed with space from another, and a switch for controlling these metal layers in terms of their electrical coupling. The switch is provided with a contact-point group, and a drive section. The contact-point group includes a plurality of contact-point pairs each disposed in parallel between each two of the corresponding metal layers. The drive section mechanically drives the contact-point group for changing each of the contact-point pairs in state between in-contact and no-contact.

With the transmission/reception element in the aspect of the invention, when the drive section in the switch starts driving the contact-point group, the contact-point pairs are each changed in state between in-contact and no-contact so that the metal layers are controlled in terms of their electrical coupling. With the switch control as such, over the entire metal layers all being conducting, radio waves are transmitted/received at the frequency corresponding to the electrical length of the metal layers. Herein, by mechanically driving the contact-point group as such, the drive circuits can be each disposed with space from the corresponding metal layer so that any possible influence to be exerted by electromagnetic waves coming from the drive circuits is suppressed. Moreover, when the metal layers are each disposed with a physical space from another, any desired level of radiation characteristics are indeed difficult to obtain, but such physical spaces between the metal layers are reduced in size with the configuration that each of a plurality of contact-point pairs is disposed in parallel in the contact-point group.

According to the transmission/reception element in an aspect of the invention, in a switch of controlling a plurality of metal layers in terms of their electrical coupling, a drive section mechanically drives a contact-point group, and therefore the radiation of electromagnetic waves coming from a drive circuit may be suppressed. Also with the configuration that a plurality of contact-point pairs are each disposed in parallel in the contact-point group, the physical spaces between the metal layers can be reduced in size so that any desired level of radiation characteristics can be obtained with more ease. Accordingly, with the radiation characteristics satisfactorily retained, frequency switching can be performed among a plurality of patterns.

BRIEF DESCRIPTION OF THE DRAWINGS

FIG. 3A shows the reconfigurable antenna in an open state, and FIG. 3B shows it in a close state;

DETAILED DESCRIPTION OF THE PREFERRED EMBODIMENTS

In the below, embodiments of the invention are described in detail by referring to the accompanying drawings. Note that the description is given in the following order.

1. First Embodiment (exemplary reconfigurable antenna in which metal patterns are disposed in series)
2. Modified Example 1 (another example of the first embodiment)
3. Second Embodiment (exemplary reconfigurable antenna in which metal patterns are disposed two-dimensionally)
4. Third Embodiment (exemplary monopole antenna)
5. Fourth Embodiment (exemplary bowtie antenna)
6. Modified Example 2 (another example of the fourth embodiment)
7. Fifth Embodiment (exemplary reconfigurable antenna in which triangle-shaped metal patterns are disposed two-dimensionally)
8. Application Example (exemplary electronic device using a transmission/reception element)

First Embodiment

Configuration of Reconfigurable Antenna 1

Figure 1:
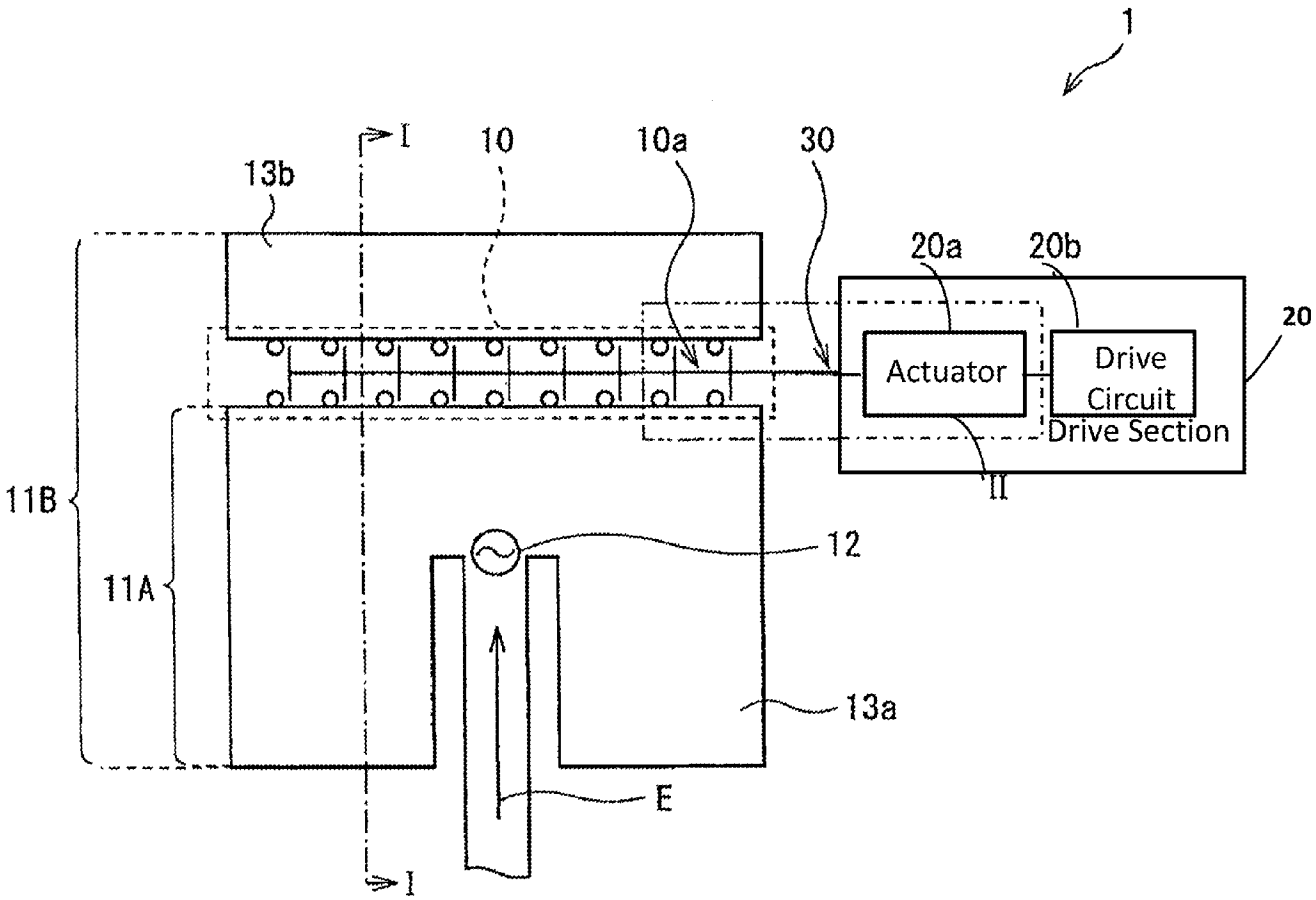
FIG. 1 is a plan view of a reconfigurable antenna in a first embodiment of the invention, showing the schematic configuration thereof.
Figure 2:
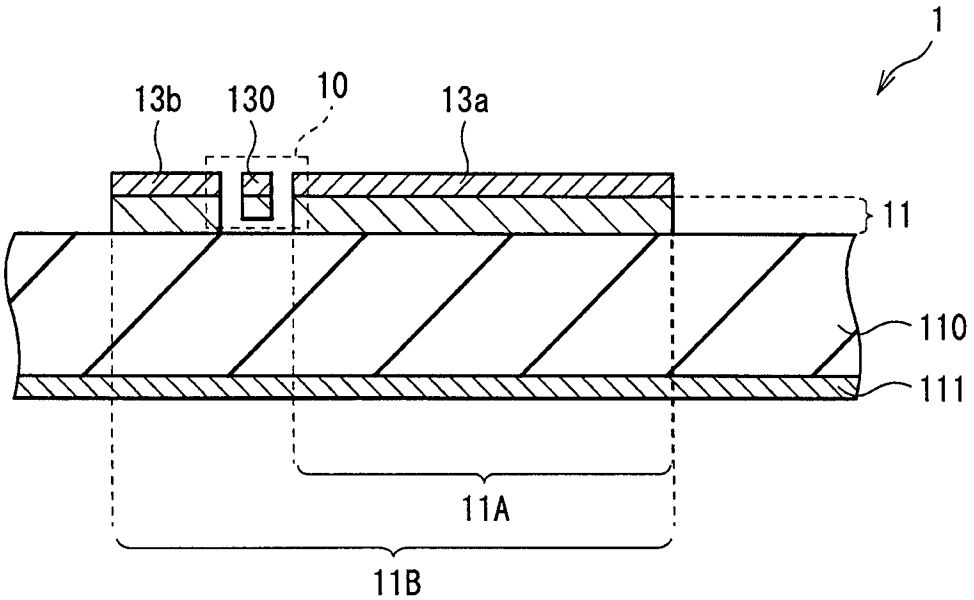
FIG. 2 is a cross sectional view of the reconfigurable antenna of FIG. 1 taken along a line I-I.

FIG. 1 is a diagram showing the schematic configuration of a reconfigurable antenna 1 in a first embodiment of the invention. FIG. 2 is a cross sectional view of the reconfigurable antenna 1 of FIG. 1 taken along a line I-I. Such a reconfigurable antenna 1 is a patch antenna (microstrip antenna) that is capable of frequency switching among a plurality of patterns through switch control. Such a reconfigurable antenna 1 includes two metal patterns 13*a* and 13*b*, which are disposed with space from each other in a predetermined region on the surface of a dielectric layer 110, for example. One of the two metal patterns, e.g., the metal pattern 13*a* in this example, is provided with a feeding point 12 for a supply of current (voltage) along a feeding direction E. To the space between the metal patterns 13*a* and 13*b*, a contact-point group 10 is provided, and this contact-point group 10 is being coupled with a drive section 20 via a push rod 30. This drive section 20 drives the contact-point group 10. These components, i.e., the contact-point group 10, the drive section 20, and the push rod 30, all function as a switch for controlling the metal patterns 13*a* and 13*b* in terms of electrical coupling therebetween. A ground layer 111 is formed on the undersurface of the dielectric layer, and is grounded.

A substrate 11 is a dielectric substrate configured by a silicon (Si) substrate covered on the surface by an insulation film made of silicon nitride (SiN), silicon oxide ($SiO_2$), or others, for example.

The metal patterns 13*a* and 13*b* each function as a radiation section (emission and propagation section) in the reconfigurable antenna 1, and each include a metal film made of gold (Au), aluminum (Al), copper (Cu), and others. This metal film and the substrate 11 may sandwich therebetween a thin film made of titanium (Ti), chromium (Cr), tungsten (W), and others for use as a close-contact layer. Alternatively, the metal patterns 13*a* and 13*b* may include precious metal such as platinum (Pt), ruthenium (Ru), and rhodium (Rh). In this embodiment, these metal patterns 13*a* and 13*b* are each shaped like a rectangle in the planar view, for example, and are disposed in series along the feeding direction E to oppose each other on one side. In this example, similarly to a movable contact point 14*a* and a fixed contact point 14*b* that will be described later, the metal patterns 13*a* and 13*b* are each also a lamination film including a film made of gold formed on a film made of titanium.

Such metal patterns 13*a* and 13*b* are electrically insulated from each other by being placed with space from each other on the dielectric layer 110, and are controlled in terms of electrical coupling therebetween by switching of the contact-point group 10 between open operation (OFF operation) and close operation (ON operation). Such switching will be described later in detail. To be specific, when the metal patterns 13*a* and 13*b* are electrically insulated from each other, only the metal pattern 13*a* serves as a radiation section, i.e., radiation section 11A. When the metal patterns 13*a* and 13*b* are electrically conducting, the whole region across the metal patterns, i.e., region from the metal pattern 13*a* to the metal pattern 13*b*, serves as a radiation section, i.e., radiation section 11B.

The contact-point group 10 includes a plurality of contact-point pairs 10*a*, each of which is arranged in parallel. As an example, these contact-point pairs 10*a* are arranged along the opposing sides of the metal patterns 13*a* and 13*b* almost entirely across the space therebetween. The contact-point group 10 is disposed on one end side of the push rod 30 extending in the direction along which the contact-point pairs 10*a* are arranged.

The drive section 20 is configured to include an actuator 20*a*, and a drive circuit 20*b* that drives the actuator 20*a*. As the actuator 20*a*, suitably used is a MEMS (Micro-Electro-Mechanical Systems) actuator made by the MEMS technology, for example, and especially an electrostatic actuator operated by lateral driving.

The push rod 30 is coupled to the drive section 20 on one end, and, a part of the contact-point group specifically, contact-point bars 30*a* and the movable contact points 14*a* that will be described later is provided on the other end side.

Figures 3A, 3B:
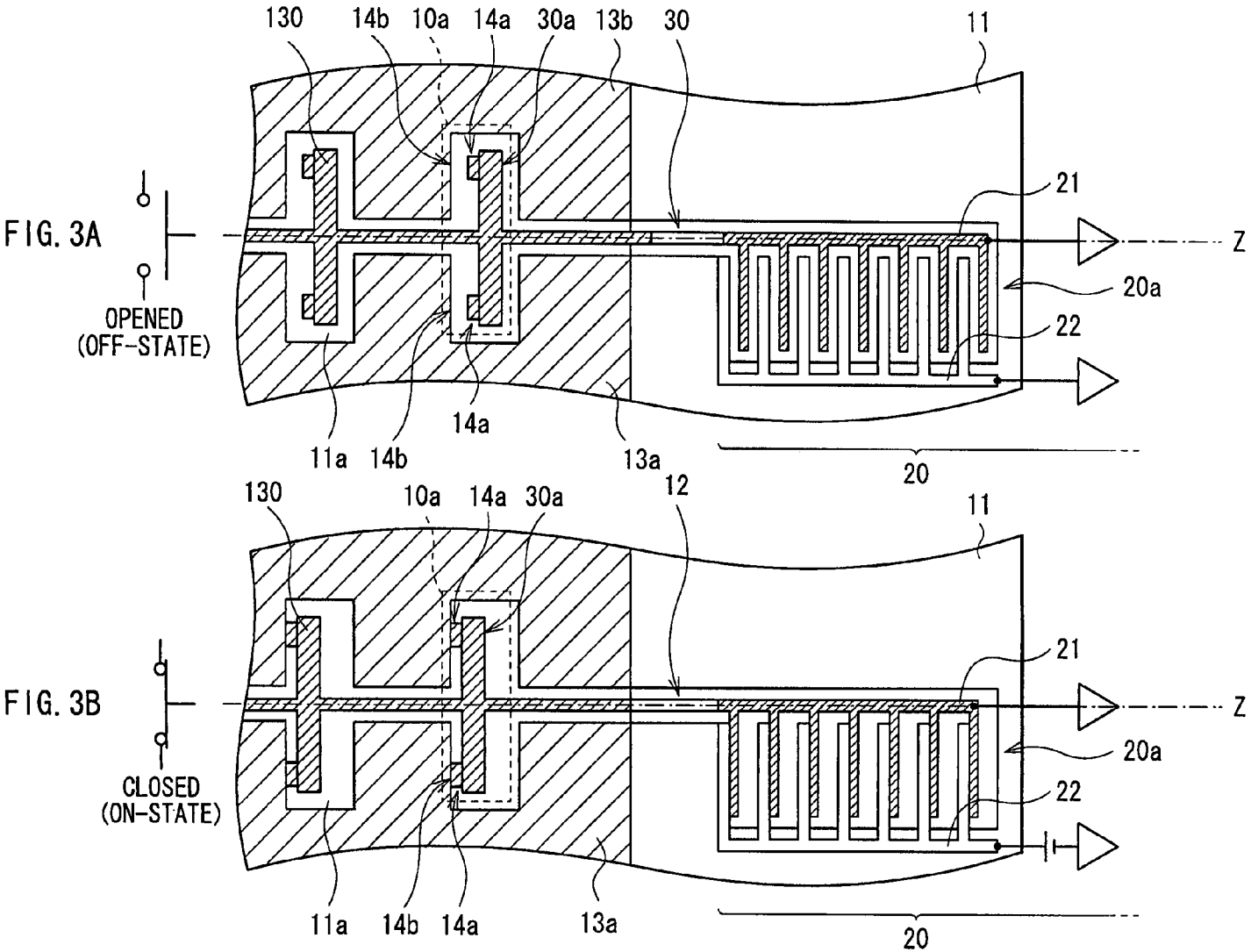
FIGS. 3A and 3B are each a plan view of the reconfiguration antenna of FIG. 1, showing the configuration of a portion in proximity to a region II, and specifically.

By referring to FIGS. 3A and 3B, a description is given about the specific configurations of those components, i.e., the contact-point group 10 (the contact-point pairs 10*a*), the drive section 20, and the push rod 30. FIGS. 3A and 3B are each a diagram showing a portion in proximity to a region II of FIG. 1, i.e., the portion in proximity to the border between the contact-point group 10 and the metal patterns 13*a* and 13*b*, and the drive section 20. Specifically, FIG. 3A shows the reconfigurable antenna in the OFF state, and FIG. 3B shows it in the ON state;

In this embodiment, the space between the metal patterns 13*a* and 13*b* is a cavity 11*a* housing therein the push rod 30 to be slidable. The push rod 30 is a rod-like member extending along the direction in which the contact-point pairs 10*a* are arranged, i.e., along an operation axis Z. The push rod is provided with a plurality of contact-point bars 30*a* each protruding in the direction orthogonal to the operation axis Z. The wall surface of the cavity 11*a*, i.e., the plane where the metal patterns 13*a* and 13*b* are opposing each other, is shaped with concavities and convexities to match with the shape of the push rod 30 and that of the corresponding contact-point bar 30*a*, i.e., shaped like comb teeth. The metal patterns 13*a* and 13*b* are disposed so as to sandwich the push rod 30 therebetween and the contact-point bars 30*a* to allow engagement between such a shape with concavities and convexities and each corresponding protruding contact-point bar 30*a*.

The push rod 30 and the contact-point bar 30*a* are each configured by a base covered by a metal film 130 on the surface. The base is configured similarly to the substrate 11, and the metal film 130 is made of a material similar to that of the movable contact point 14*a* and the fixed contact point 14*b*, for example. Note here that, in the push rod 30, the metal film 130 covers only portions corresponding to the metal patterns 13*a* and 13*b*, i.e., the radiation sections 11A and 11B.

To the wall surface of the cavity 11*a*, i.e., the surface shaped with concavities and convexities where the metal patterns 13*a* and 13*b* are opposing each other, a plurality of fixed contact points 14*b* are each disposed in parallel. The fixed contact points 14*b* are each being a part of the corresponding contact-point pair 10*a*. In the push rod 30, the contact-point bars 30*a* are each provided with the movable contact point 14*a* in such a manner as to oppose the corresponding fixed contact point 14*b*. These components, i.e., the contact-point bar 30*a*, the movable contact point 14*a*, and the fixed contact point 14*b*, are configuring one contact-point pair 10*a*. In such a contact-point pair 10*a*, in response to the sliding movement of the push rod 30, i.e., positional change thereof along the operation axis Z, the movable contact point 14*a* and the fixed contact point 14*b* are changed in state between in-contact (ON state) and no-contact (OFF state).

Such a cavity 11*a* can be formed by processing the substrate 11 using the MEMS technology including lithography and dry etching, for example. During the etching, the push rod 30 and the contact-point bar 30*a* are formed, i.e., extracted. After the substrate 11 is formed with the cavity 11*a* as such, the resulting substrate 11 may be formed with the metal patterns 13*a* and 13*b* on the surface, and the metal film 130 may be formed at a predetermined region of the contact-point bar 30*a* and that of the push rod 30.

The movable contact point 14*a* and the fixed contact point 14*b* are each a lamination film including a layer made of gold disposed on a layer made of titanium, for example. Such a lamination film can be formed by sputtering and photolithography, for example, and in the film, the titanium layer has the thickness of 0.1 μm, and the gold layer of 2.0 μm, for example.

In the drive section 20, such a cavity 11*a* as described above is formed to extend, and in this cavity 11*a*, the actuator 20*a* is disposed. That is, the actuator 20*a* is formed in the substrate 11 that is shared with the contact-point group 10, and is coupled to the push rod 30. Note here that a part of the push rod 30 located in the region in such a drive section 20 is not formed with the metal film 130, and from the part, the base made of a material same as that of the substrate 11 is exposed, for example. More in detail, such a part of the push rod 30 is the portion between the contact-point group 10, and the actuator 20*a*. That is, the drive section 20 is provided to the region outside of the radiation sections 11A and 11B, and the contact-point group 10 and the actuator 20*a* are electrically insulated from each other but are physically coupled together by the push rod 30. In the drive section 20, the drive circuit 20*b* of the actuator 20*a* is provided to the region beyond the actuator 20*a*, and is sufficiently away from the contact-point pair 10*a* and the metal patterns 13*a* and 13*b*.

The actuator 20*a* is configured to include a movable electrode 21, and a fixed electrode 22. The movable electrode 21 slides along the operation axis same as that of the push rod 30, i.e., operation axis Z, and the fixed electrode 22 is fixed to the substrate 11. This actuator 20*a* is a so-called electrostatic MEMS actuator operated by lateral driving, i.e., is operated to displace the movable electrode 21 along the operation axis Z by the electrostatic force.

The movable electrode 21 and the fixed electrode 22 are each a comb-teeth electrode, and are disposed so as to engage with each other. The movable electrode 21 and the fixed electrode 22 as such are formed as below, for example. That is, the substrate 11 is subjected to three-dimensional processing using the technologies of etching and lithography to form a base in the comb-teeth shape. The resulting base is covered on the surface with a metal film similarly to the movable contact point 14*a* and the fixed contact point 14*b* described above, i.e., lamination film including gold and titanium layers. The movable electrode 21 is coupled to the push rod 30 or is formed as a piece therewith, and the push rod 30 is configured to slide in response to the sliding movement of the movable electrode 21.

Note that, in this example, the actuator 20*a* is surely not restricted to such an electrostatic actuator, and any other types of actuators operated in another driving mode utilizing the MEMS capabilities are also applicable, e.g., piezoelectric actuator, electromagnetic actuator, and bimetallic actuator.

(Operation Effects of Reconfigurable Antenna 1)

(Operation Effects of Frequency Switching)

In this embodiment, as shown in FIG. 1, the two metal patterns 13*a* and 13*b* are disposed with the contact-point group 10 sandwiched therebetween, and the electrical coupling between these metal patterns 13*a* and 13*b* is controlled by switching of the contact-point group 10 between the OFF operation and the ON operation. To be specific, during the OFF operation, the metal patterns 13*a* and 13*b* are electrically insulated from each other, and electromagnetic waves come only from the metal pattern 13*a* including the feeding point 12, i.e., the radiation section 11A is put in operation. On the other hand, during the ON operation, the metal patterns 13*a* and 13*b* are electrically conducting, and electromagnetic waves come from these metal patterns 13*a* and 13*b* in their entirety across the area, i.e., the radiation section 11B is put in operation.

Figure 4A:
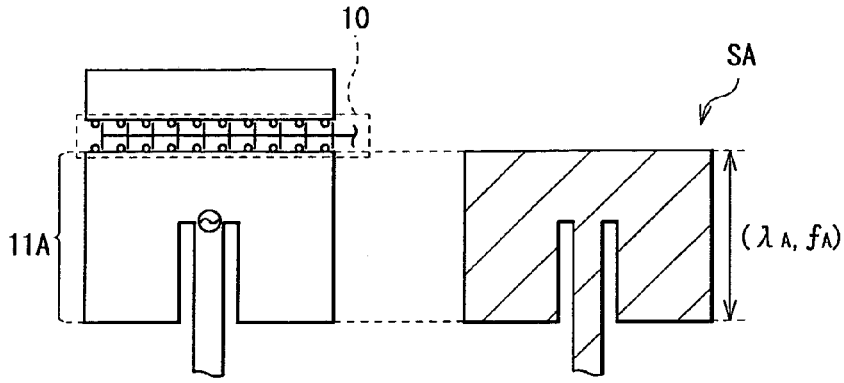
FIGS. 4A and 4B are schematic diagrams for illustrating the operation effects of the reconfigurable antenna of FIG. 1.
Figure 4B:
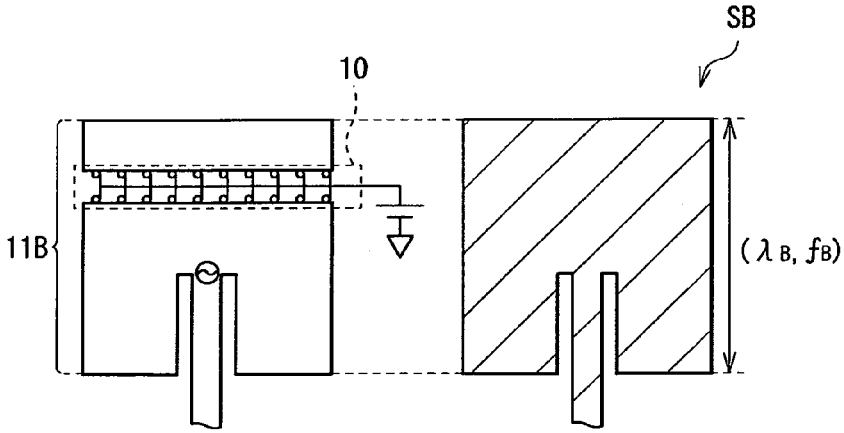

In such a reconfigurable antenna 1, the electromagnetic waves are radiated at the frequency corresponding to the electrical length of the radiation sections therein. As an example, as shown in FIG. 4A, during the OFF operation, the electromagnetic waves are radiated at a frequency $f_A$ corresponding to an electrical length of the radiation section 11A. On the other hand, as shown in FIG. 4B, during the ON operation, the electromagnetic waves are radiated at a frequency $f_B$ corresponding to an electrical length $\lambda_B$ of the radiation section 11B. Assuming that the metal patterns 13*a* and 13*b* are formed on a printed circuit made of FR4 (Flame Retardant Type 4), for example, two frequencies (base frequencies) of $f_A$=60 GHz and $f_B$=50 GHz are obtained when $\lambda_A$=1.1, and $\lambda_B$=1.5.

The electromagnetic waves that can be radiated from the antenna are of the base frequency, and of a frequencies that are integral multiples of the base frequency. Accordingly, the electromagnetic waves that are to be radiated from the antenna in this embodiment are of the frequencies $f_A$ and $f_B$, and frequencies that are integral multiples of the frequencies $f_A$ and $f_B$, i.e., frequencies $f_A$, $2f_A$, $3f_A$, and others, and $f_B$, $2f_B$, $3f_B$, and others. In other words, through control by the contact-point group 10 over the electrical coupling between the two metal patterns 13*a* and 13*b*, the frequency switching can be performed based on two frequencies of $f_A$ and $f_B$.

(Operation Effects for Radiation Characteristics)

Figure 5A:
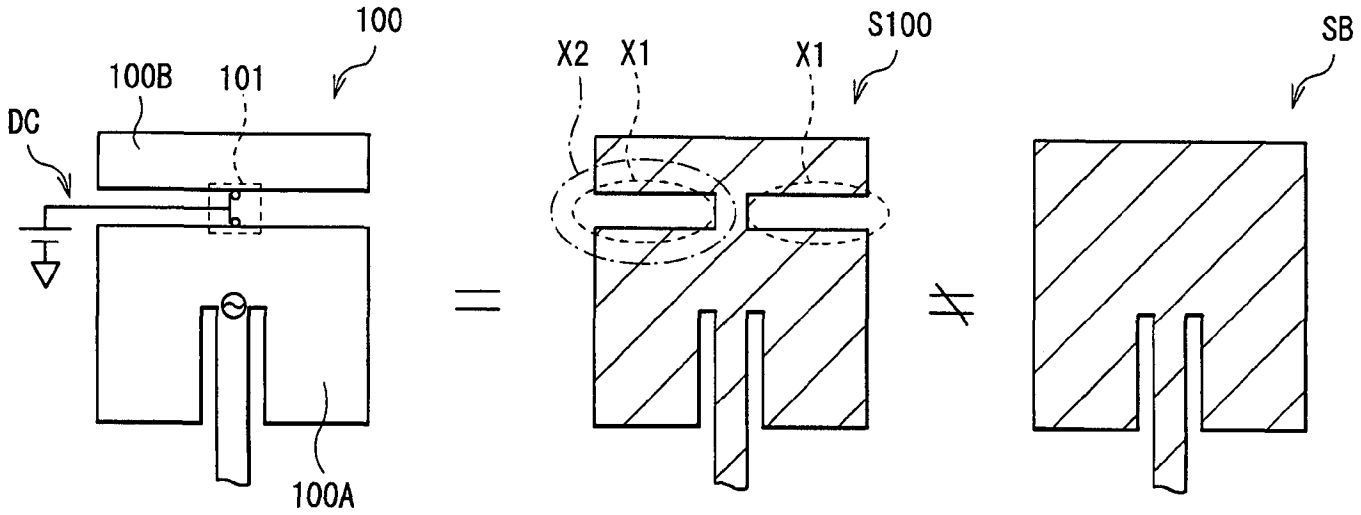
FIGS. 5A and 5B are schematic diagrams of reconfigurable antennas in comparison examples 1 and 2, respectably, showing their schematic configurations.
Figure 5B:
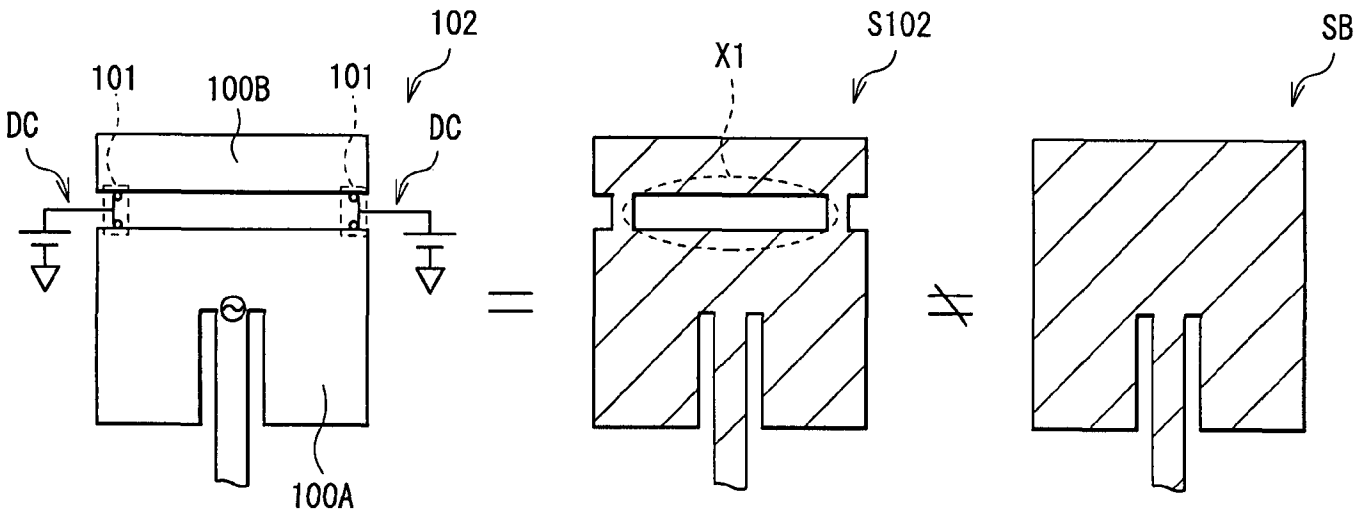

FIG. 5A shows a reconfigurable antenna 100 in a comparison example 1, and FIG. 5B shows a reconfigurable antenna 102 in a comparison example 2. These reconfigurable antennas 100 and 102 are those performing frequency switching using a switch 101 based on two frequencies by controlling the electrical coupling between two metal patterns 100A and 100B disposed with space therebetween.

The reconfigurable antenna 100 is configured to include the switch 101 only in the region in proximity to the center space between the metal patterns 100A and 100B. As such, in the reconfigurable antenna 100, the radiation surface (radiation surface S100) in the radiation section is formed with a large notch X1 when the metal patterns 100A and 100B are electrically conducting. The notch X1 formed as such causes a problem of narrowing the band of radiation characteristics, and the resulting patterns of radiation are distorted. Moreover, due to the configuration that the switch 101 is connected with a drive circuit DC for switch control use, the influence by radiation of electromagnetic waves X2 from the drive circuit DC resultantly decreases the antenna directivity. In other words, unlike any ideal radiation surface (radiation surface SB) when the metal patterns 100A and 100B are electrically conducting, the radiation surface S100 has difficulty in achieving the radiation characteristics of any desired level.

On the other hand, the reconfigurable antenna 102 is configured to include the switch 101 in proximity to each end of the space between the metal patterns 100A and 100B. As such, the switches 101 in the reconfigurable antenna 102 are located closer to the outside so that the drive circuit DC can be positioned away from the metal patterns 100A and 100B. This thus reduces the influence by radiation of the electromagnetic waves from the drive circuit DC as described above. The problem here is that, however, the notch X1 still exists on the radiation surface (radiation surface S102) in the radiation section when the metal patterns 100A and 100B are electrically conducting. In other words, unlike the radiation surface SB, the radiation surface S102 still has difficulty in achieving the radiation characteristics of any desired level.

On the other hand, in the embodiment, the metal patterns 13*a* and 13*b* are controlled in terms of electrical coupling therebetween by the drive section 20 mechanically driving the contact-point group 10. To be specific, using such an actuator 20*a* as shown in FIGS. 3A and 3B, a switch control operation is performed as below.

When receiving a command for the close operation, i.e., for switching to the ON state, when being in the OFF state with no voltage application, the drive section 20 applies a drive voltage between the movable electrode 21 and the fixed electrode 22 in the actuator 20*a*. In response thereto, an electromagnetic force is generated between the movable electrode 21 and the fixed electrode 22, and the movable electrode 21 slides along the operation axis Z to be close to the fixed electrode 22. In accordance therewith, the push rod 30 slides along the operation axis Z, and then comes in contact with the contact-point pairs 10*d* so that the state is changed to ON (FIG. 3B). On the other hand, when receiving a command for the open operation, i.e., for switching to the OFF state, when being in the ON state with a voltage application, the drive section 20 stops the voltage application between the movable electrode 21 and the fixed electrode 22. In response thereto, the magnetic force is not generated any more between the movable electrode 21 and the fixed electrode 22, and the movable electrode 21 slides along the operation axis Z as if to move away from the fixed electrode 22. In accordance therewith, the push rod 30 slides along the operation axis Z, then the contact with the contact-point pairs 10*d* is broken so that the push rod 30 is put back to the position of FIG. 3A. Note that, in the drive circuit 20*b* (not shown in FIGS. 3A and 3B), the actuator 20*a* is driven desirably with the movable electrode 21 being grounded, and with the fixed electrode 22 being at a control potential. This is because the push rod 30 can remain at the GND potential through the connection with the movable electrode 21.

As such, when the push rod 30 is driven by the actuator 20*a*, and when the push rod 30 is moved to slide (displaced) along the operation axis Z, in response to such a sliding movement, the contact-point pairs 10*a* in the contact-point group 10 are changed in state between in-contact and no-contact. By such a state change, the metal patterns 13*a* and 13*b* are controlled in terms of electrical coupling therebetween.

The driving force from the drive circuit 20*a* is converted into the mechanical motion in the actuator 20*a*, and this mechanical motion is transmitted to each of the contact-point pairs 10*a* via the push rod 30. In other words, the mechanical coupling will only do between the contact-point group 10 and the drive section 20, and the components in the layout can remain insulated from each other, thereby being able to reduce any possible influence by radiation of the electromagnetic waves coming from the drive circuit 20*b* including the switch control line and others.

Figure 6:
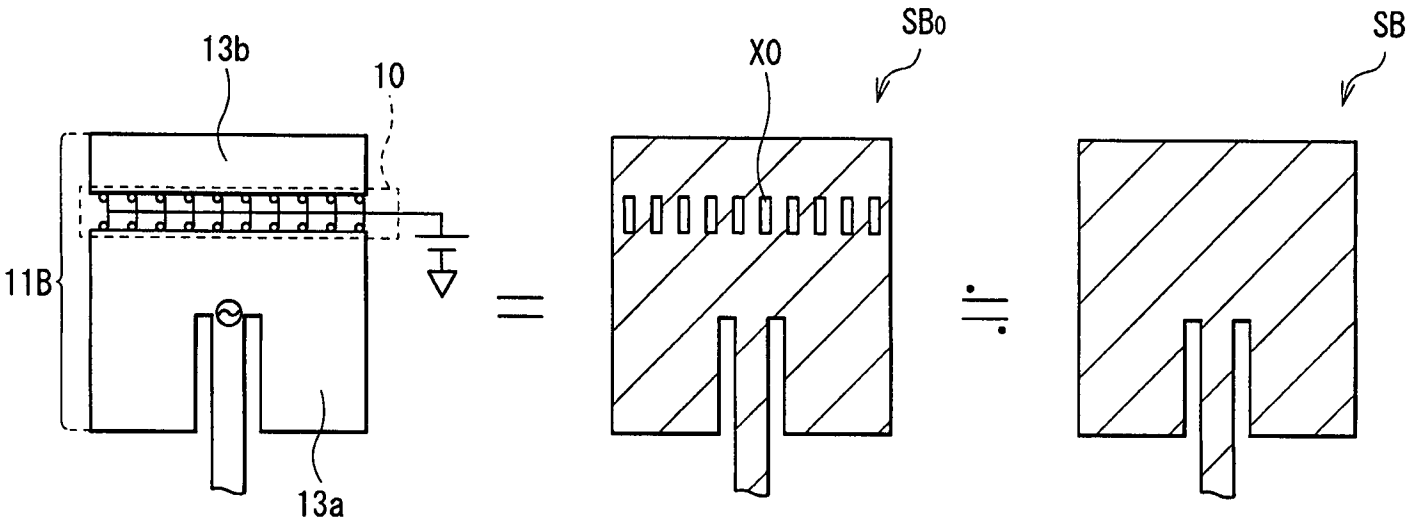
FIG. 6 is a schematic diagram for illustrating the radiation characteristics of the reconfigurable antenna of FIG. 1.

Also in the embodiment, a plurality of contact-point pairs 10*a* being the contact-point group 10 are each disposed in parallel between the metal patterns 13*a* and 13*b*. With such a configuration, as shown in FIG. 6, when the metal patterns 13*a* and 13*b* are electrically conducting, the radiation surface (radiation surface $SB_0$) in the radiation section 11B is formed with a plurality of notches X0 depending on the spacing between the contact-point pairs 10*a*. However, these notches X0 are each extremely small in size, and thus the resulting radiation surface $SB_0$ is approximately equivalent to the radiation surface SB. Moreover, such a plurality of contact-point pairs 10*a* can be collectively driven by a piece of drive section 20 so that, compared with a configuration of including the drive section to each of the contact-point pairs, the drive circuits and the control lines can be considerably reduced in number.

Furthermore, in this embodiment, as shown in FIGS. 3A and 3B, the wall surface of the cavity 11*a*, i.e., the plane where the metal patterns 13*a* and 13*b* are opposing each other, is shaped with concavities and convexities to match with the shape of the push rod 30 and that of the contact-point bar 30*a*, and the push rod 30 and the contact-point bar 30*a* are each covered on the surface by the metal film 130. With such a configuration, as shown in FIG. 6, the space between the metal patterns 13*a* and 13*b* is reduced in size to a further degree so that the notches X0 are also reduced in size on the radiation surface $SB_0$. As a result, the radiation surface $SB_0$ of the radiation section 11B is more analogous to the ideal radiation surface SB.

Figure 7:
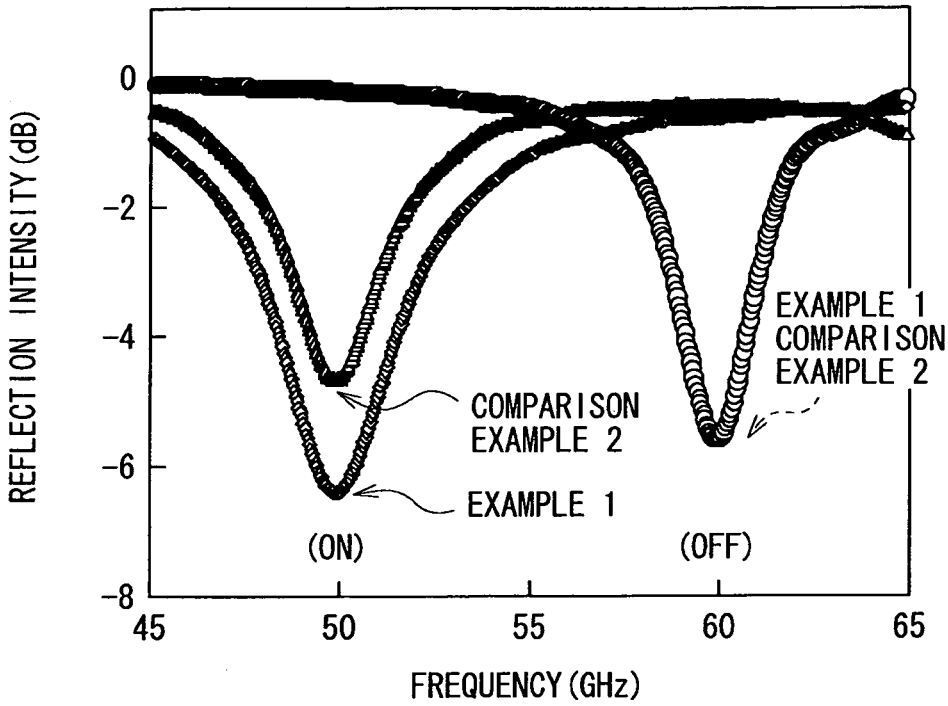
FIG. 7 is a characteristics diagram showing the relationship between the frequency and the reflection intensity in an example 1.

As an example of the first embodiment, i.e., example 1, the reflection intensity (dB) with respect to the frequency (GHz) of the reconfigurable antenna 1 is calculated using an electromagnetic simulator. FIG. 7 shows the calculation result. Note that the characteristics indicated by a broken arrow are those of the radiation section 11A (electrical length $\lambda_A$, and frequency $f_A$) when the metal patterns 13*a* and 13*b* are electrically insulated from each other, i.e., in the OFF state. The characteristics indicated by a solid arrow are those of the radiation section 11B (electrical length $\lambda_B$, and frequency $f_B$) when the metal patterns 13*a* and 13*b* are electrically conducting, i.e., in the ON state. In the OFF state, settings are made as $\lambda_A$=1.1, and $\lambda_B$=1.5 in the ON state. Also for the reconfigurable antenna 102 in the comparison example 2 described above, the reflection intensity with respect to the frequency is calculated similarly for use as a comparison example of this example 1.

With the calculation results in both of the example 1 and the comparison example 2, the resonance frequency is observed at 60 GHz in the OFF state (electrical length $\lambda_A$=1.1), and in the ON state (electrical length $\lambda_B$=1.5), the resonance occurs at 50 GHz. These results tell that both the example 1 and the comparison example 2 implement the reconfigurable antenna of including the two values of base frequency, i.e., 50 GHz and 60 GHz. Note here that, in the ON state, the reflection intensity in the example 1 shows the peak higher about by 2 dB than that in the comparison example 2. This indicates that the reconfigurable antenna in the example 1 has a higher gain and is excellent in directivity compared with the antenna in the comparison example 2. In other words, this tells that the radiation characteristics are to be improved with the configuration of including a plurality of contact-point pairs 10*a* each disposed in parallel, and by mechanically driving those contact-point pairs 10*a*.

As such, in the embodiment, the drive section 20 controls the metal patterns 13*a* and 13*b* in terms of electrical coupling therebetween by mechanically driving the contact-point group 10 so that the drive circuit 20*b* can be disposed away from the contact-point group 10. This configuration accordingly reduces any possible influence by electromagnetic waves coming from the drive circuit 20*b*. Moreover, the contact-point group 10 includes a plurality of contact-point pairs 10*a* each disposed in parallel so that the metal patterns 13*a* and 13*b* are reduced in physical space therebetween, and this favorably helps the resulting reconfigurable antenna to have any desired radiation characteristics. As such, the reconfigurable antenna in this embodiment can perform frequency switching among a plurality of patterns (frequency switching based on the base frequencies $F_A$ and $F_B$ in this example) while being able to retain satisfactorily the radiation characteristics.

Modified Example 1

Figure 8:
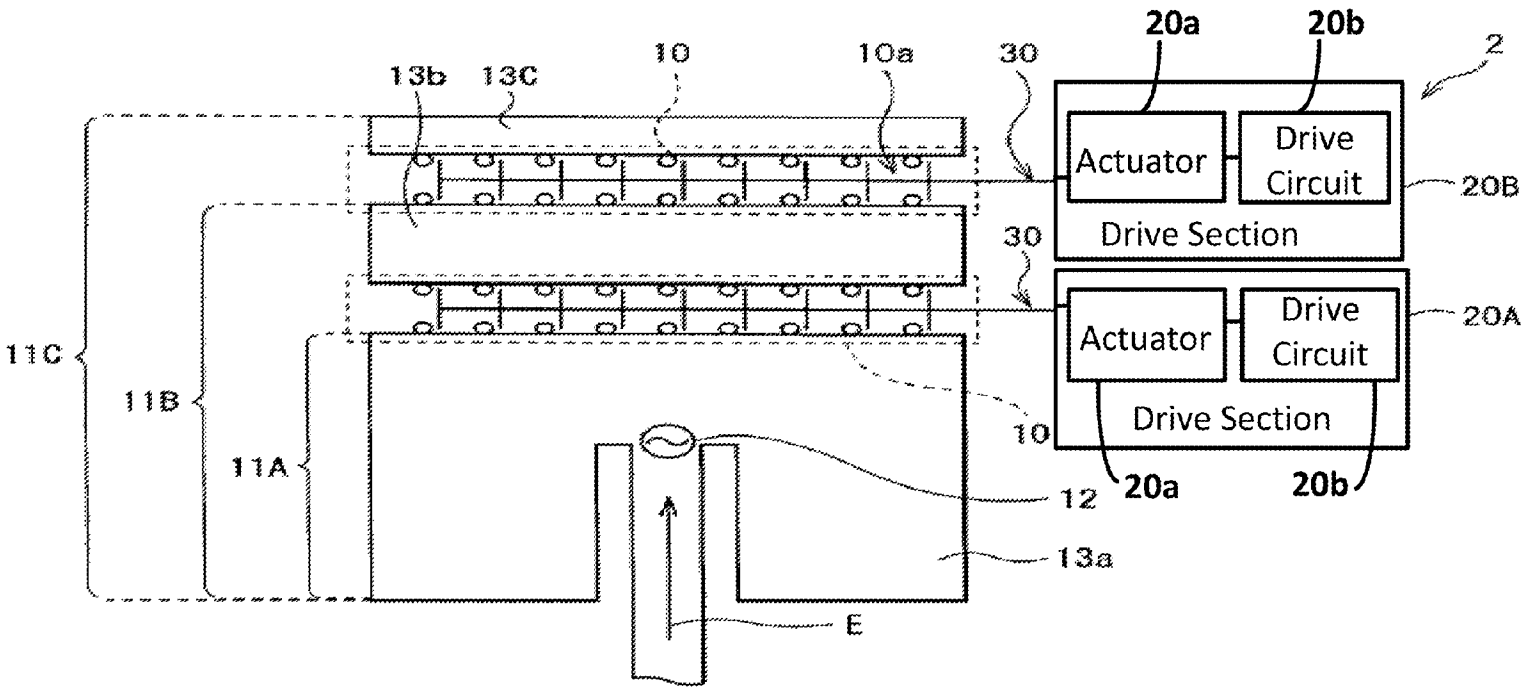
FIG. 8 is a plan view of a reconfigurable antenna of a modified example 1, showing the schematic configuration thereof.

FIG. 8 is a diagram showing the schematic configuration of a reconfigurable antenna 2 in a modified example of the first embodiment described above. Similarly to the reconfigurable antenna 1 described above, this reconfigurable antenna 2 is a patch antenna in which a plurality of rectangular-shaped metal patterns are disposed in series along the feeding direction E via the contact-point groups 10. The contact-point groups 10 are respectively coupled with the drive sections 20A and 20B via the push rod 30, and are mechanically driven so that the contact-point pairs 10*a* therein are changed in state between in-contact and no-contact. Note that any component similar to that in the first embodiment described above is provided with the same reference numeral, and is not described again if appropriate.

However, unlike the reconfigurable antenna 1 described above, the reconfigurable antenna 2 in this modified example is provided with three metal patterns in total including a metal pattern 13*c* in addition to the metal patterns 13*a* and 13*b*, and the contact-point group 10 is provided between the metal patterns 13*a* and 13*b*, and between the metal patterns 13*b* and 13*c*. These contact-point groups 10 are respectively coupled with the drive sections 20A and 20B. Similarly to the drive section 20 described above, the drive sections 20A and 20B are each provided with the actuator 20*a* coupled to the corresponding push rod 30, and the drive circuit 20*b* for driving the actuator 20*a*.

These metal patterns 13*a* to 13*c* are electrically insulated from each other by being disposed with space from one another on the dielectric layer, but are controlled in terms of their electrical coupling by switching of the contact-point groups 10 between the open operation (OFF operation) and the close operation (ON operation) similarly to the first embodiment described above. Moreover, based on the state of electrical coupling between the metal patterns 13*a* and 13*b*, either of the radiation section 11A or 11B is activated. Note that, in this modified example, the metal patterns 13*b* and 13*c* are made to be electrically conducting to activate the region across the metal patterns, i.e., region from the metal pattern 13*a* to the metal pattern 13*c*, as another radiation section, i.e., radiation section 11C.

Figure 9A:
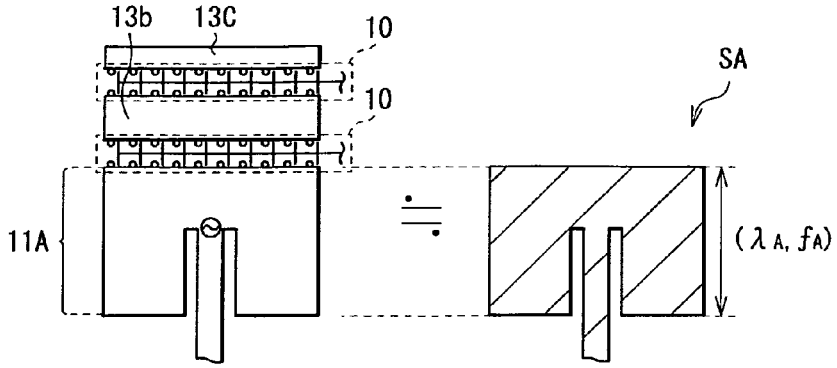
FIGS. 9A to 9C are schematic diagrams for illustrating the operation effects of the reconfigurable antenna of FIG. 8.

In this modified example, the three metal patterns 13*a* to 13*c* are disposed with the contact-point groups 10 sandwiched therebetween, and these contact-point groups 10 each serve to control the electrical coupling between the metal patterns 13*a* and 13*b*, and between the metal patterns 13*b* and 13*c*. As shown in FIG. 9A, when these metal patterns are all electrically insulated from one another, the electromagnetic waves are radiated from the radiation section 11A at the frequency $f_A$ corresponding to the electrical length $\lambda_A$ thereof.

Figure 9B:
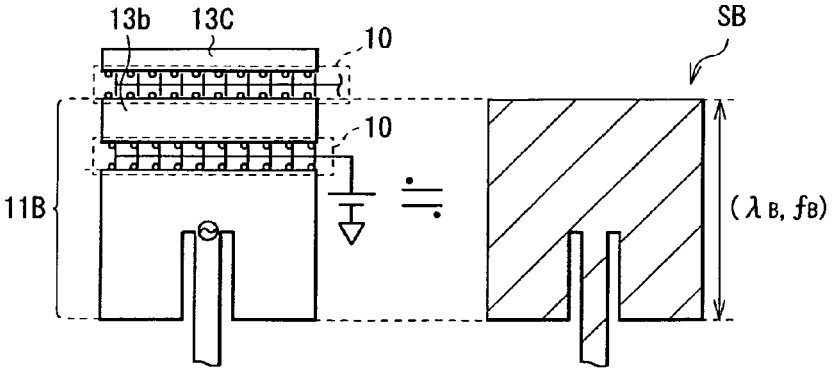
Figure 9C:
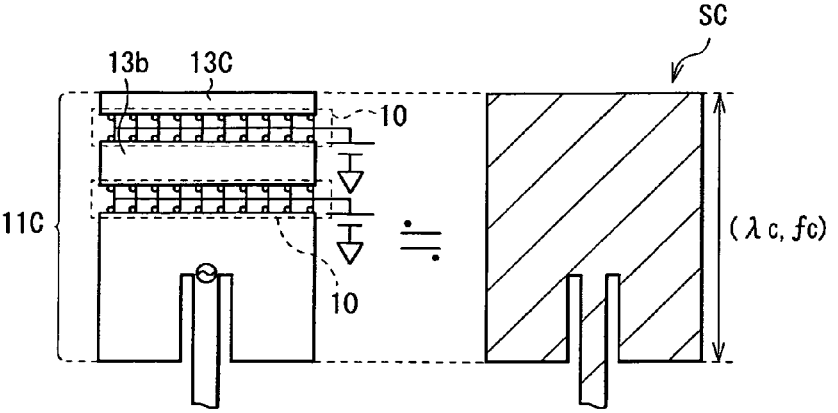

On the other hand, as shown in FIG. 9B, when the metal patterns 13*a* and 13*b* are electrically conducting by the drive section 20A driving the corresponding contact-point group 10, the electromagnetic waves are radiated from the radiation section 11B at the frequency $f_B$ corresponding to the electrical length $\lambda_B$ thereof. Moreover, as shown in FIG. 9C, when the metal patterns 13*a* and 13*b* are electrically conducting to each other by the drive section 20A driving the corresponding contact-point group 10, and also when the metal patterns 13*b* and 13*c* are electrically conducting to each other by the drive section 20B driving the corresponding contact-point group 10, the electromagnetic waves are radiated from the radiation section 11C at the frequency $f_C$ corresponding to the electrical length $\lambda_C$ thereof. As such, in this modified example, the electromagnetic waves that are to be radiated are of the frequencies $f_A$, $f_B$, and $f_C$, and frequencies that are integral multiples of the frequencies $f_A$, $f_B$, and $f_C$, i.e., frequencies $f_A$, $2f_A$, $3f_A$, and others, $f_B$, $2f_B$, $3f_B$, and others, and frequencies $f_C$, $2f_C$, $3f_C$, and others. In other words, the frequency switching can be performed based on three values of frequency, i.e., $f_A$, $f_B$, and $f_C$.

As such, the number of the metal patterns disposed with space from one another on the dielectric layer is not surely restricted to two as described in the first embodiment above, and may be three as in this modified example or may be four or more. In any case, the effects similar to those in the first embodiment described above can be achieved as long as the contact-point group is sandwiched between the metal patterns, and the drive section is provided for mechanical driving of each of the contact-point groups. In this modified example, such effects by the mechanical driving of the contact-point groups and the parallel arrangement of the contact-point pairs become more significant because the switches for use are increased in number as the metal patterns are increased in number, and as the range of frequencies available for switching becomes wider.

Moreover, when the number of the metal patterns provided in this modified example is three or more, it means that the number of the contact-point groups 10 is two or more. In such a case, driving of the contact-point groups 10 may be started one after another from any of those located on the side of the feeding point 12 for changing the state from OFF to ON. Such a procedure of driving is applicable also to embodiments and modified examples that will be described below.

Second Embodiment

Figure 10:
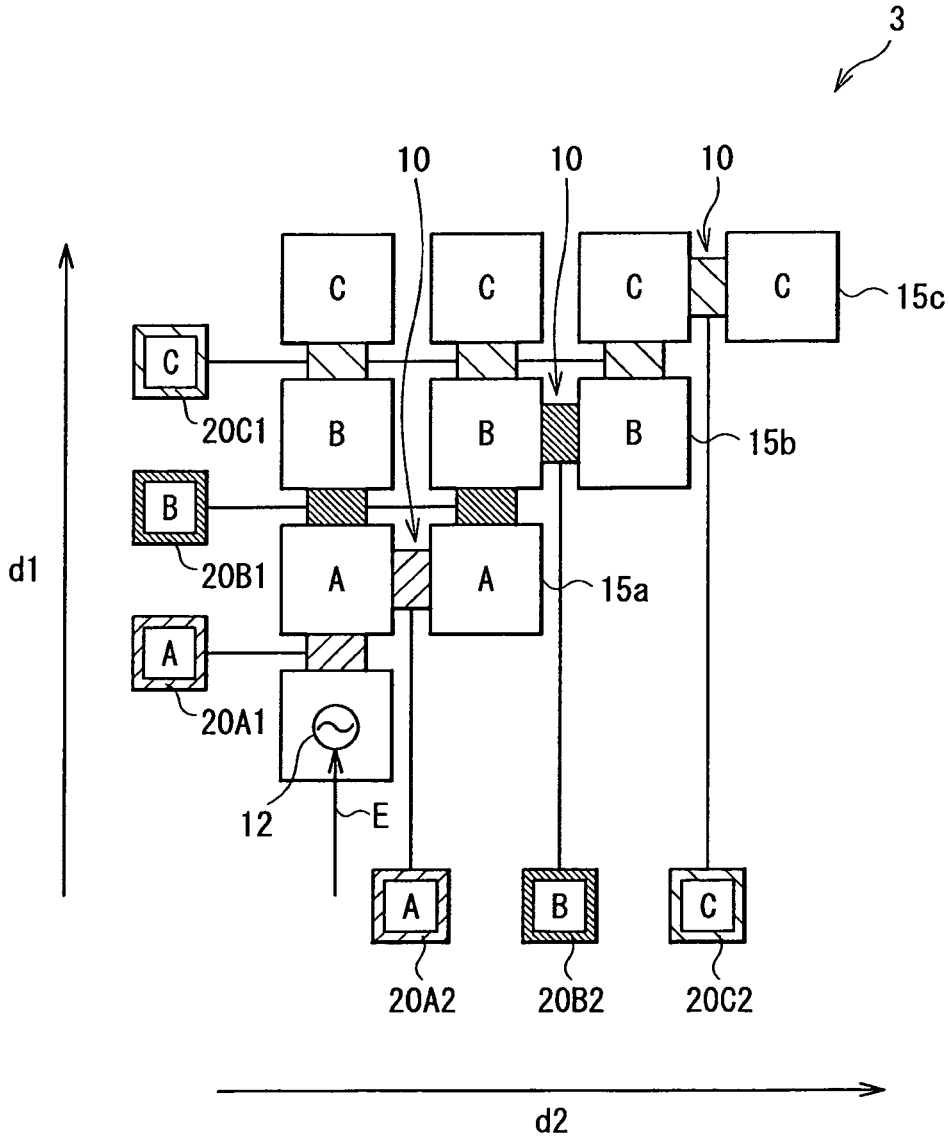
FIG. 10 is a plan view of a reconfigurable antenna in a second embodiment of the invention, showing the schematic configuration thereof.

FIG. 10 is a diagram showing the schematic configuration of a reconfigurable antenna 3 in a second embodiment of the invention. Similarly to the reconfigurable antenna 1 in the first embodiment described above, this reconfigurable antenna 3 is a patch antenna that is capable of frequency switching among a plurality of patterns, and the contact-point group 10 is sandwiched between each two of a plurality of metal patterns 15*a* to 15*c* disposed with space from each other. These contact-point groups 10 are each coupled to the drive section via the push rod 30, and are changed in state between in-contact and no-contact by mechanical driving thereof. Note here that any component similar to that in the first embodiment described above is provided with the same reference numeral, and is not described again if appropriate.

However, unlike the reconfigurable antenna 1 in the first embodiment described above, the metal patterns 15*a* to 15*c* in the reconfigurable antenna 3 in the second embodiment are two-dimensionally disposed in two directions, i.e., a direction d1 along the feeding direction E, and a direction d2 orthogonal to the feeding direction E. To be specific, along the direction d1, the metal patterns 15*a* to 15*c* are disposed in order of 15*a*, 15*b*, and 15*c* from the side of the feeding point 12, and along the direction d2, the metal pattern 15*a* is disposed in line with another, the metal pattern 15*b* is disposed in line with two others, and the metal pattern 15*c* is disposed in line with three others. In this example, such groups of the metal patterns 15*a* to 15*c* are respectively made electrically conducting all at once. In other words, the electrical coupling of the metal patterns is controlled on the basis of their groups aligned along the direction d2. In FIG. 10, for convenience, the metal patterns 15*a* to 15*c* are each denoted by any of "A" to "C" depending on to which group it belongs.

In the space between any two of these metal patterns 15*a* to 15*c*, the contact-point group 10 is provided. However, every space does not include the contact-point group 10 but the space between any two metal patterns adjacent to each other along the direction d1, i.e., metal patterns in different groups, and the space between any two metal patterns adjacent to each other along the direction d2, i.e., metal patterns in the same group.

The contact-point groups 10 are coupled to either any of drive sections 20A1 to 20C1 or any of drive sections 20A2 to 20C2 depending on along which direction d1 or d2. To be specific, the contact-point group 10 between the feeding point 12 and the metal pattern 15*a* is coupled to the drive section 20A1, the contact-point group 10 between the metal patterns 15*a* and 15*b* is coupled to the drive section 20B1, and the contact-point group 10 between the metal patterns 15*b* and 15*c* is coupled to the drive section 20C1. The contact-point group 10 between the two metal patterns 15*a* is coupled to the drive section 20A2, the contact-point group 10 between predetermined two of the three metal patterns 15*b* is coupled to the drive section 20B2, and the contact-point group 10 between predetermined two of the four metal patterns 15*c* is coupled to the drive section 20C2. The drive sections 20A1 to 20C1, and the drive sections 20A2 to 20C2 are each provided with the actuator 20*a* coupled to the push rod 30, and the drive circuit 20*b* for driving the actuator 20*a* similarly to the drive section 20 in the first embodiment described above.

In this embodiment, as described above, the metal patterns 15*a* to 15*c* are two-dimensionally disposed along the two directions, i.e., the direction d1 along the feeding direction E, and the direction d2 orthogonal to the feeding direction E. These metal patterns are mechanically controlled by the contact-point groups 10 in terms of their electrical coupling. With a patch antenna, the length of the plane shape thereof along the feeding direction E is a control factor for the frequency, and the length thereof orthogonal to the feeding direction E is a control factor for the band, i.e., antenna directivity. In other words, in this embodiment, the direction d1 is the basis for the frequency switching, and the direction d2 is the basis for the control of antenna directivity.

Figure 11A:
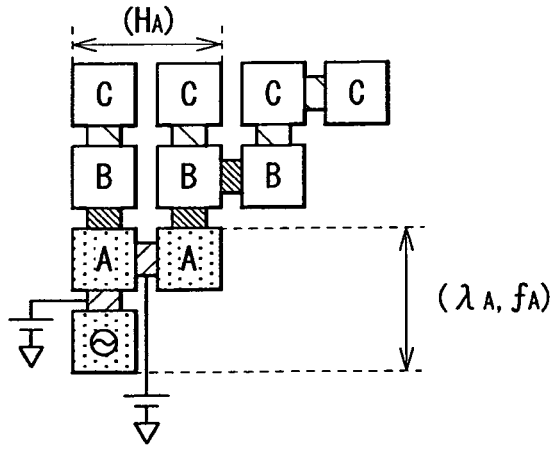
FIGS. 11A to 11C are schematic diagrams for illustrating the operation effects of the reconfigurable antenna of FIG. 10.
Figure 11B:
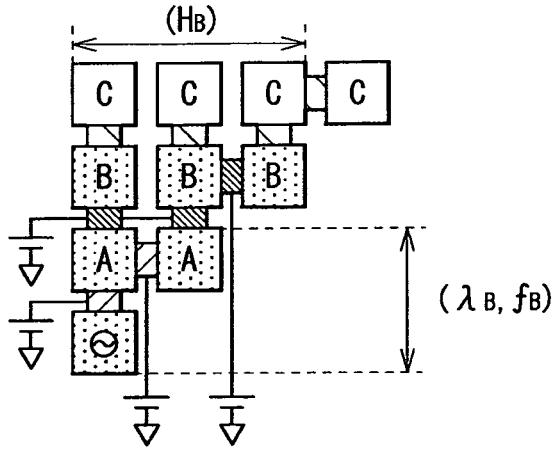
Figure 11C:
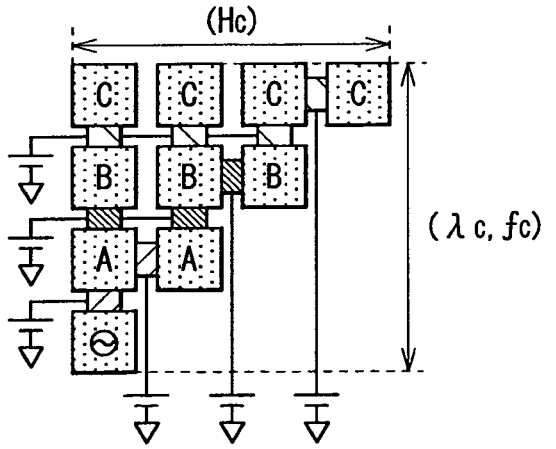

To be specific, when the drive sections 20A1 and 20A2 bring electrical conduction to the feeding point 12 and the metal pattern 15*a*, and to the two metal patterns 15*a*, the region from the feeding point 12 to the metal pattern 15*a* serves as the radiation section, and electromagnetic waves are radiated therefrom at the frequency $f_A$ with the bandwidth of $H_A$ (FIG. 11A). When the drive sections 20B1 and 20B2 bring electrical conduction to the metal patterns 15*a* and 15*b*, and to the three metal patterns 15*b*, the region from the feeding point 12 to the metal patterns 15*b* serves as the radiation section, and electromagnetic waves are radiated therefrom at the frequency $f_B$ with the bandwidth of $H_B$ (FIG. 11B). Moreover, when the drive sections 20C1 and 20C2 bring electrical conduction to the metal patterns 15*b* and 15*c*, and to the four metal patterns 15*c*, the whole region from the feeding point 12 to the metal patterns 15*c* serves as the radiation section, and electromagnetic waves are radiated therefrom at the frequency $f_C$ with the bandwidth of $H_C$ (FIG. 11C).

As described above, in the second embodiment, the effects similar to those achieved in the first embodiment described above can be achieved by using the contact-point groups 10 to mechanically control the electrical coupling between the metal patterns 15*a* to 15*c*, which are each disposed with space from another. Moreover, the resulting antenna can be controlled not only in terms of frequency but also in terms of directivity by the two-dimensional arrangement of the metal patterns 15*a* to 15*c* along the two directions of d1 and d2, and by the cumulative electrical conduction of the metal patterns 15*a* to 15*c*.

In the comparison examples 1 and 2, as described above, if the switches are disposed to the center portion and therearound of the region serving as the radiation section, the electromagnetic waves coming from the drive circuit or others adversely affect the radiation characteristics. In order to avoid such adverse influence, there is no way but to dispose the switches outside of the antenna. As a result, unlike the reconfigurable antenna in the embodiment, the resulting reconfigurable antenna cannot be controlled in both frequency and directivity by being changed in dimension two-dimensionally. On the other hand, with the reconfigurable antenna in the embodiment that can be arbitrarily controlled in dimension two-dimensionally, the antenna characteristics can be controlled with attention to details because any change in environment for transmission and reception is used as a basis to realize the optimum transmission-reception sensitivity.

Note that, in the second embodiment described above, the two-dimensionally-arranged metal patterns are controlled in terms of their electrical coupling on the group basis arranged along the direction d2. This is surely not restrictive, and alternatively, the electrical coupling among the metal patterns may be controlled on the group basis arranged along the direction d1, or may be controlled on the metal pattern basis.

Third Embodiment

Figure 12:
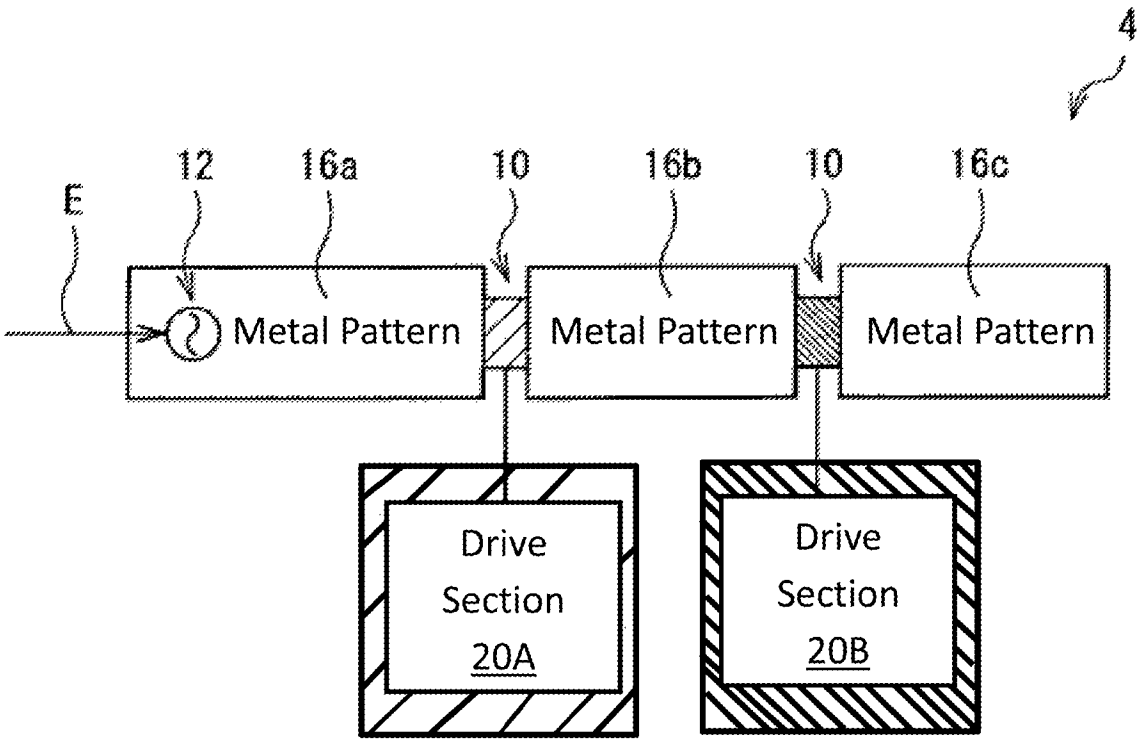
FIG. 12 is a plan view of a reconfigurable antenna in a third embodiment of the invention, showing the schematic configuration thereof.

FIG. 12 is a diagram showing the schematic configuration of a reconfigurable antenna 4 in a third embodiment of the invention. The reconfigurable antenna 4 is capable of frequency switching among a plurality of patterns similarly to the reconfigurable antenna 1 in the first embodiment described above. In the reconfigurable antenna 4, three metal patterns 16*a* to 16*c* are each disposed with space from another along the feeding direction E, and the contact-point group 10 is provided between each two of these metal patterns 16*a* to 16*c* for mechanical driving respectively by the drive sections 20A and 20B. Note here that any component similar to that in the first embodiment described above is provided with the same reference numeral, and is not described twice if appropriate.

Note that the reconfigurable antenna 4 in this embodiment is a so-called monopole antenna, and the metal patterns 16*a* to 16*c* are formed on the surface of a cylindrical dielectric body extending along the feeding direction E. The reconfigurable antenna 4 is also provided with the drive sections 20A and 20B. The drive section 20A is in charge of driving the contact-point group 10 disposed between the metal patterns 16*a* and 16*b*, and the drive section 20B is in charge of driving the contact-point group 10 disposed between the metal patterns 16*b* and 16*c*.

Figure 13A:
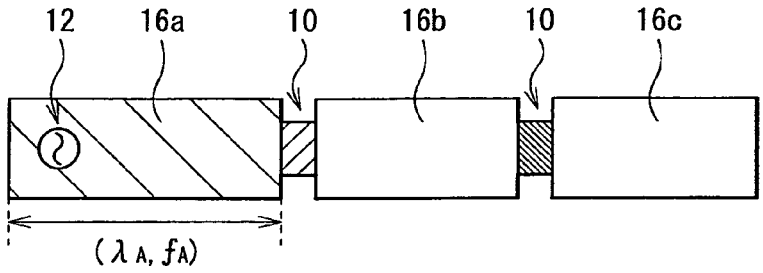
FIG. 13A to 13C are schematic diagrams for illustrating the operation effects of the reconfigurable antenna of FIG. 12.
Figure 13B:
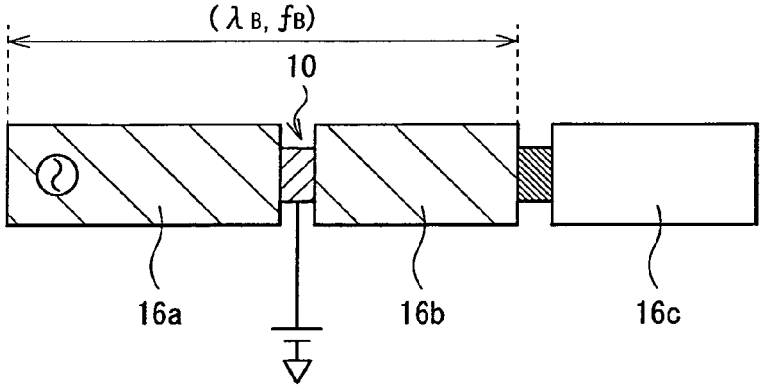
Figure 13C:
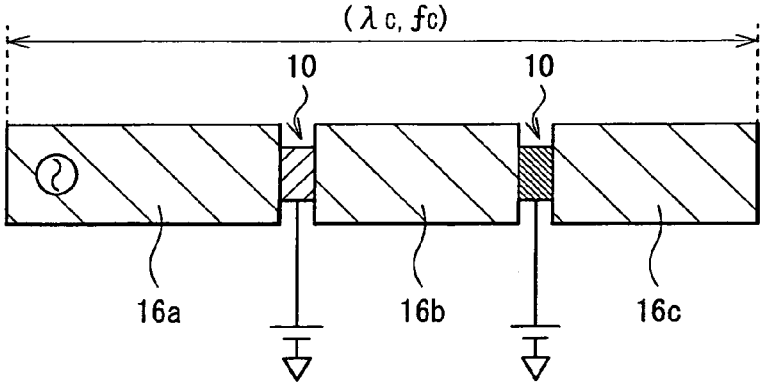

Also in this embodiment, the metal patterns 16*a* to 16*c* are each disposed with space from another along the feeding direction E as described above, and the electrical coupling among these metal patterns is mechanically controlled by the contact-point groups 10. In such a reconfigurable antenna, when the metal patterns 16*a* and 16*b* are electrically insulated from each other, the metal pattern 16*a* serves as the radiation section, and electromagnetic waves are radiated therefrom at the base frequency of $f_A$ (FIG. 13A). On the other hand, when the drive section 20A brings electrical conduction to the metal patterns 16*a* and 16*b*, the region across the metal patterns, i.e., region from the metal pattern 16*a* to the metal pattern 16*b*, serves as the radiation section, and electromagnetic waves coming therefrom are at the base frequency of $f_B$ (FIG. 13B). Moreover, when the drive section 20B brings electrical conduction to the metal patterns 16*b* and 16*c*, the region across the metal patterns, i.e., region from the metal pattern 16*a* to the metal pattern 16*c*, serves as the radiation section, and electromagnetic waves are radiated therefrom at the base frequency of $f_C$ (FIG. 13C). With such a configuration, the effects similar to those achieved in the first embodiment described above can be achieved. Herein, such a monopole antenna is surely not the only option, and a so-called dipole antenna is also a possibility for application.

Fourth Embodiment

Figure 14:
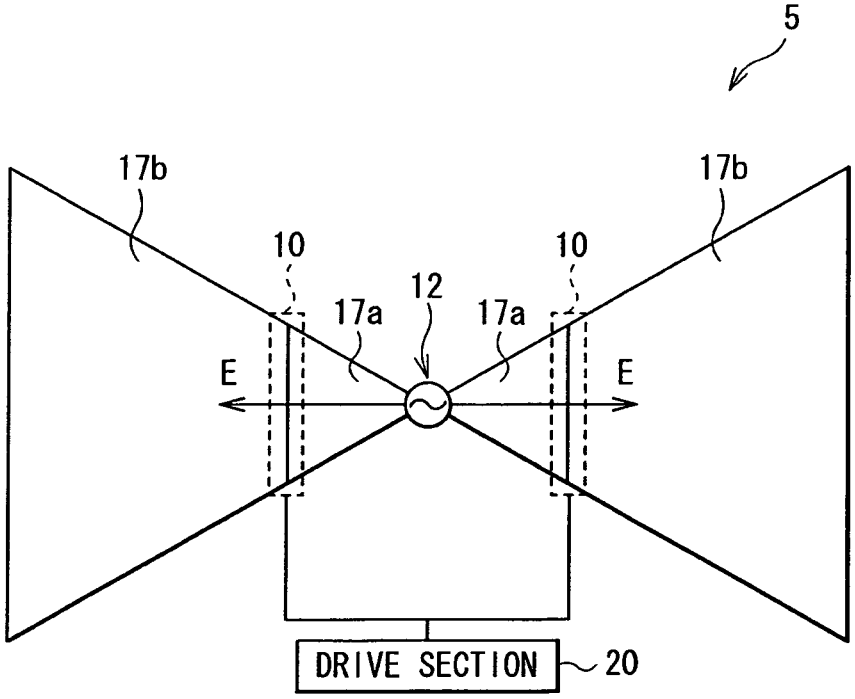
FIG. 14 is a plan view of a reconfigurable antenna in a fourth embodiment of the invention, showing the schematic configuration thereof.

FIG. 14 is a diagram showing the schematic configuration of a reconfigurable antenna 5 in a fourth embodiment of the invention. The reconfigurable antenna 5 is a patch antenna capable of frequency switching among a plurality of patterns similarly to the reconfigurable antenna 1 in the first embodiment described above. In the reconfigurable antenna 5, two metal patterns 17*a* and 17*b* are each disposed with space from another along the feeding direction E, and the contact-point group 10 is provided therebetween for mechanical driving by the drive section 20. Note here that any component similar to that in the first embodiment described above is provided with the same reference numeral, and is not described twice if appropriate.

However, unlike the reconfigurable antenna 1 in the first embodiment described above, the reconfigurable antenna 5 in this embodiment is a so-called bowtie antenna, and is symmetrical about the feeding point 12. To be symmetrical about the feeding point 12 as such, the reconfigurable antenna 5 is provided with a pair of metal patterns 17*a*, and a pair of metal patterns 17*b*, for example. The metal patterns 17*a* are each shaped like a triangle in planar view, for example, and are each so disposed that the vertex of the triangle is directed toward the feeding point 12. The metal patterns 17*b* are each shaped like a trapezoid in planar view, for example, and are each so disposed that the upper base of the trapezoid opposes the bottom of the corresponding metal pattern 17*a* shaped like a triangle.

Figure 15A:
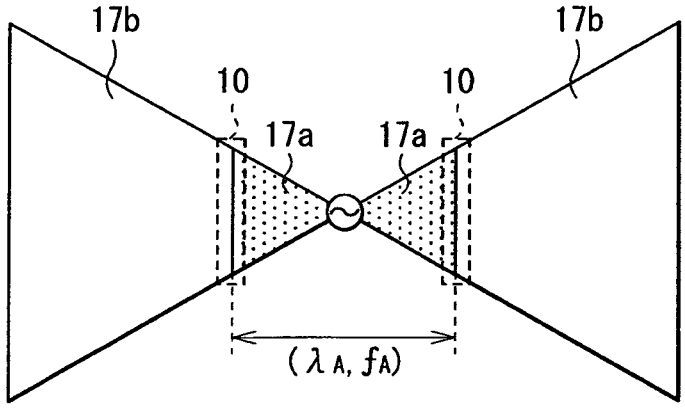
FIGS. 15A and 15B are each a schematic diagram for illustrating the operation effects of the reconfigurable antenna of FIG. 14.
Figure 15B:
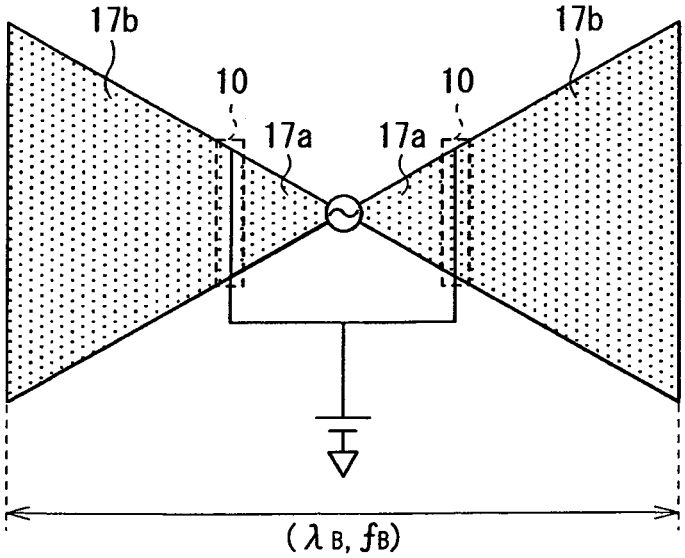

Also in the embodiment, the metal patterns 17*a* and 17*b* are each disposed with space from another along the feeding direction E, and the electrical coupling between these metal patterns 17*a* and 17*b* is mechanically controlled by the contact-point groups 10. In such a reconfigurable antenna, when the metal patterns 17*a* and 17*b* are electrically insulated from each other, only the metal patterns 17*a* in a pair serve as the radiation section, and electromagnetic waves are radiated therefrom at the base frequency of $f_A$ (FIG. 15A). On the other hand, when the drive section 20 brings electrical conduction to the metal patterns 17*a* and 17*b*, the region across the metal patterns, i.e., region from the metal pattern 17*a* to the metal pattern 17*b*, serves as the radiation section, and electromagnetic waves are radiated therefrom at the base frequency of $f_B$ (FIG. 15B). In other words, the frequency switching can be performed based on two values of frequency, i.e., $f_A$ and $f_B$. As such, the effects similar to those achieved in the first embodiment described above can be achieved.

Figure 16:
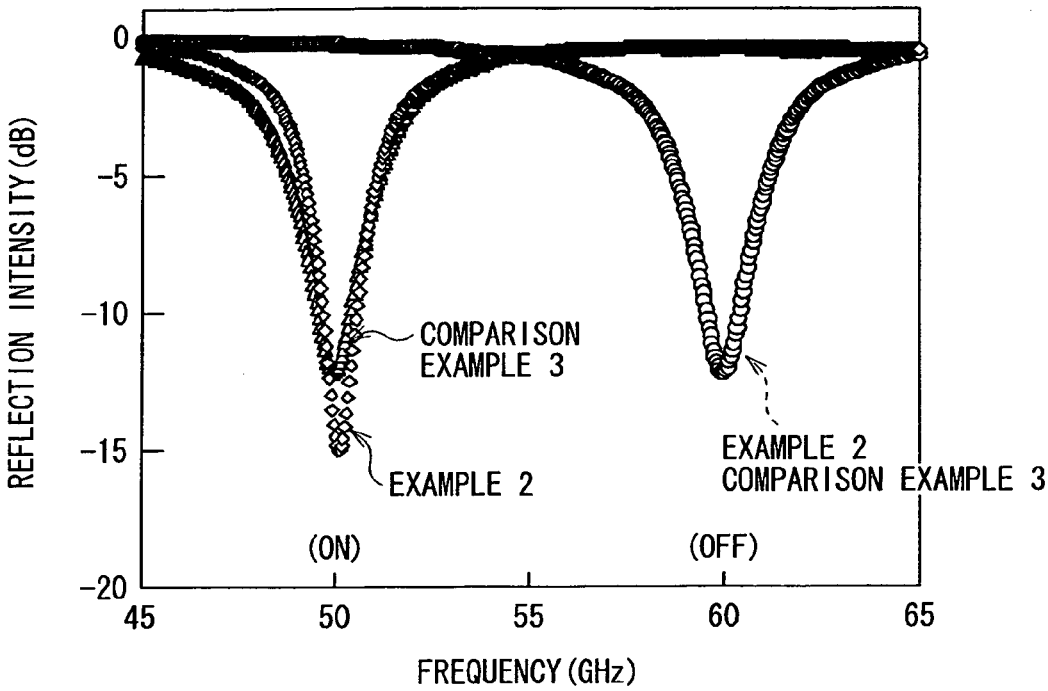
FIG. 16 is a characteristics diagram showing the relationship between the frequency and the reflection intensity in an example 2.
Figure 17:
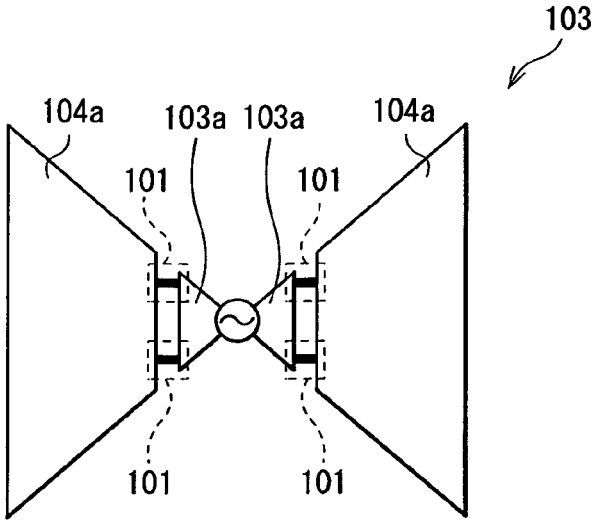
FIG. 17 is a plan view of a reconfigurable antenna of a comparison example 3, showing the schematic configuration thereof.

As an example of the fourth embodiment, i.e., example 2, the reflection intensity (dB) with respect to the frequency (GHz) of the reconfigurable antenna 5 is calculated using an electromagnetic simulator. FIG. 16 shows the calculation result. Note that the characteristics indicated by a broken arrow are those of the radiation section (electrical length $\lambda_A$, and frequency $f_A$) when the metal patterns 17*a* and 17*b* are electrically insulated from each other, i.e., in the OFF state. The characteristics indicated by a solid arrow are those of the radiation section (electrical length $\lambda_B$, and frequency $f_B$) when the metal patterns 17*a* and 17*b* are electrically conducting, i.e., in the ON state. Herein, in the OFF state, settings are made as $\lambda_A$=1.1, and $\lambda_B$=1.5 in the ON state. As a comparison example in this example 2, i.e., comparison example 3, such a calculation of reflection intensity with respect to the frequency is performed also to a reconfigurable antenna 103 as shown in FIG. 17. Herein, similarly to the reconfigurable antenna in the example 2, the reconfigurable antenna 103 in the comparison example 3 is provided with a pair of metal patterns 103*a*, and a pair of metal patterns 104*a* in such a manner as to be symmetrical about the feeding point. Herein, the switch 101 is disposed only at each end of the space between the metal patterns 103*a* and 103*b*.

With the calculation results in both of the example 2 and the comparison example 3, the resonance frequency is observed at 60 GHz in the OFF state (electrical length $\lambda_A$=1.1), and in the ON state (electrical length $\lambda_B$=1.5), the resonance occurs at 50 GHz. These results tell that both the example 2 and the comparison example 3 implement the reconfigurable antenna of including the two values of base frequency, i.e., 50 GHz and 60 GHz. Note here that, in the ON state, the reflection intensity in the example 2 shows the peak higher about by 3 dB than that in the comparison example 3. This indicates that the reconfigurable antenna in the example 2 has a higher gain and is excellent in directivity compared with the antenna in the comparison example 3. In other words, this tells that the radiation characteristics are to be improved with the configuration of including a plurality of contact-point pairs 10*a* each disposed in parallel, and by mechanically driving those contact-point pairs 10*a*.

Modified Example 2

Figure 18:
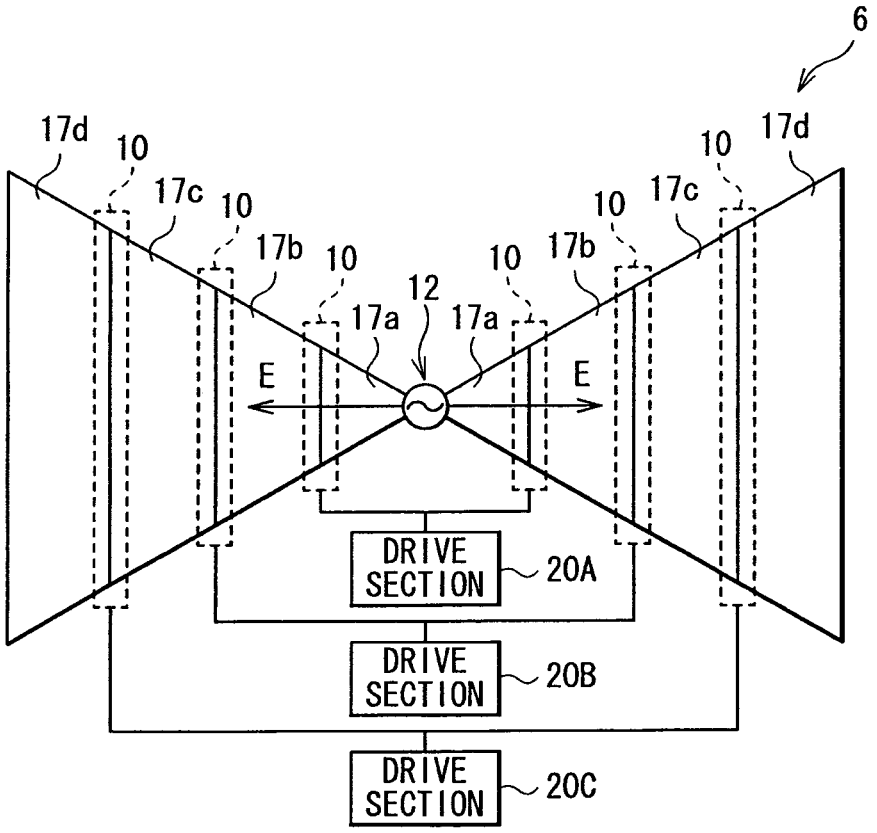
FIG. 18 is a plan view of a reconfigurable antenna of a modified example 2, showing the schematic configuration thereof.

FIG. 18 is a diagram showing the schematic configuration of a reconfigurable antenna 6 in a modified example of the fourth embodiment described above, i.e., modified example 2. The reconfigurable antenna 6 is a bowtie antenna capable of frequency switching among a plurality of patterns similarly to the reconfigurable antenna 5 described above. In the reconfigurable antenna 6, a plurality of metal patterns are each disposed with space from another along the feeding direction E, and the contact-point group 10 is provided between each two metal patterns for mechanical driving by the drive sections. Such a plurality of metal patterns is disposed to be symmetrical about the feeding point 12. Note here that any component similar to that in the first and fourth embodiments described above is provided with the same reference numeral, and is not described twice if appropriate.

However, unlike the reconfigurable antenna 5 described above, the reconfigurable antenna 6 in this modified example is provided with four metal patterns 17*a* to 17*d* in total. The metal patterns 17*c* and 17*d* are each shaped like a trapezoid in planar view similarly to the metal pattern 17*b*, and are so disposed that the bottoms of the trapezoids are opposing each other, for example. In the reconfigurable antenna 6, the drive section 20A drives the contact-point group 10 between the metal patterns 17*a* and 17*b*, the drive section 20B drives the contact-point group 10 between the metal patterns 17*b* and 17*c*, and the drive section 20C drives the contact-point group 10 between the metal patterns 17*c* and 17*d*.

Figure 19A:
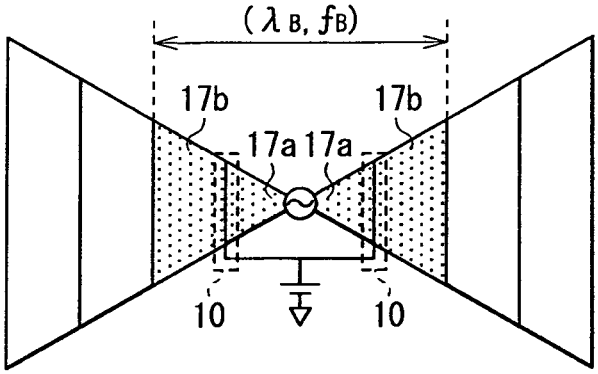
FIGS. 19A to 19C are schematic diagrams for illustrating the operation effects of the reconfigurable antenna of FIG. 18.
Figure 19B:
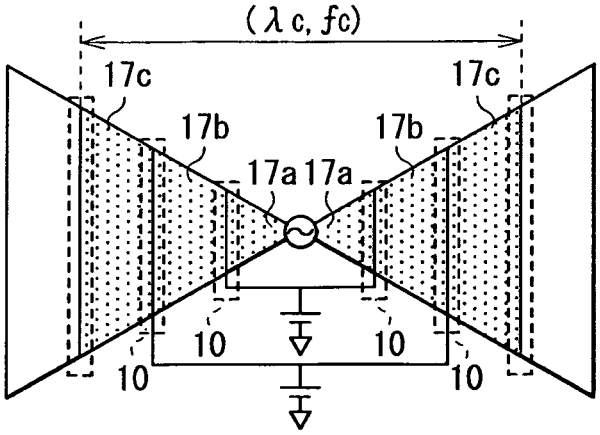
Figure 19C:
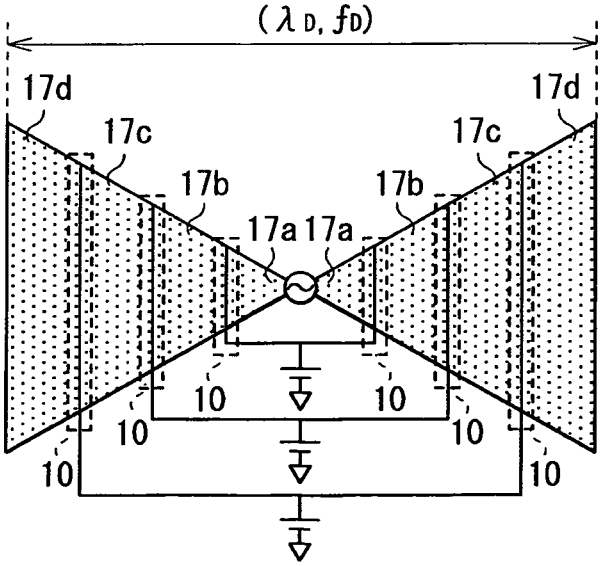

Also in this modified example, the metal patterns 17*a* to 17*d* are each disposed with space from another along the feeding direction E as described above, and the electrical coupling between these metal patterns is mechanically controlled by the contact-point groups 10. In such a reconfigurable antenna, when the metal patterns 17*a* and 17*b* are electrically insulated from each other, only the metal patterns 17*a* in a pair serve as the radiation section, and electromagnetic waves are radiated therefrom at the base frequency of $f_A$ (not shown). On the other hand, when the drive section 20A brings electrical conduction to the metal patterns 17*a* and 17*b*, the region across the metal patterns, i.e., region from the metal pattern 17*a* to the metal pattern 17*b*, serves as the radiation section, and electromagnetic waves are radiated therefrom at the base frequency of $f_B$ (FIG. 19A). Moreover, when the drive section 20B brings electrical conduction to the metal patterns 17*b* and 17*c*, the region across the metal patterns, i.e., region from the metal pattern 17*a* to the metal pattern 17*c*, serves as the radiation section, and electromagnetic waves are radiated therefrom at the base frequency of $f_C$ (FIG. 19B). Moreover, when the drive section 20C brings electrical conduction to the metal patterns 17*c* and 17*d*, the region across the metal patterns, i.e., region from the metal pattern 17*a* to the metal pattern 17*d*, serves as the radiation section, and electromagnetic waves are radiated therefrom at the base frequency of $f_D$ (FIG. 19C). In other words, the frequency switching can be performed based on four values of frequency, i.e., $f_A$ to $f_D$.

As such, the number of the metal patterns is not surely restricted to two as described in the fourth embodiment above, and may be four as in this modified example or may be three, or five or more. In any case, the effects similar to those in the first to fourth embodiments described above can be achieved as long as the contact-point group is sandwiched between each two of the metal patterns, and the drive section is provided for mechanical driving of each of the contact-point groups.

Fifth Embodiment

Figure 20:
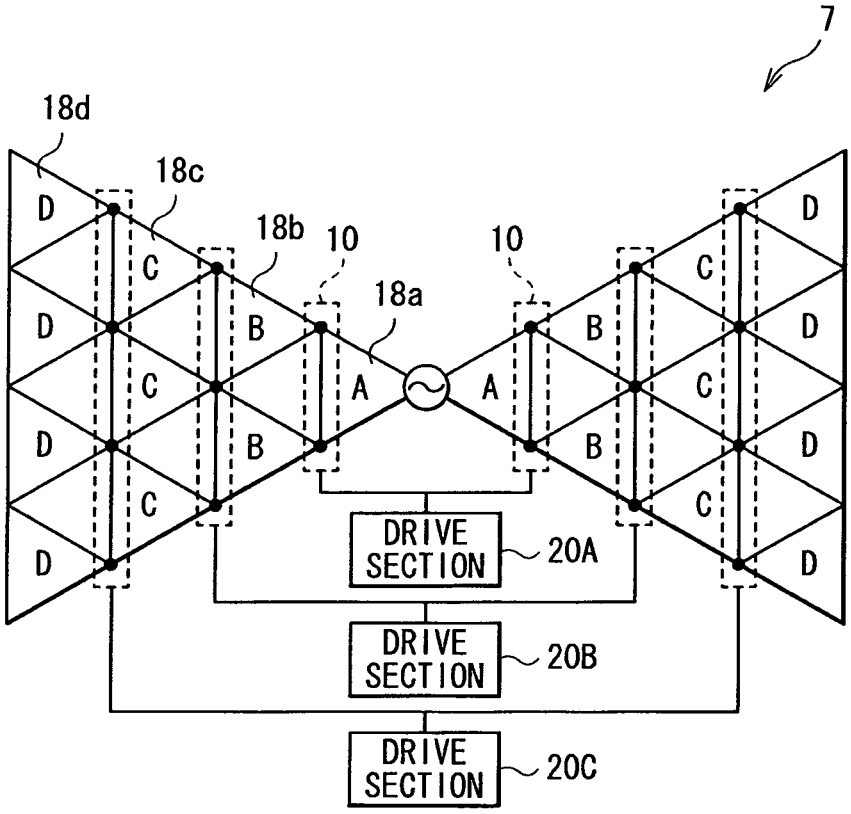
FIG. 20 is a plan view of a reconfigurable antenna in a fifth embodiment of the invention, showing the schematic configuration thereof.

FIG. 20 is a diagram showing the schematic configuration of a reconfigurable antenna 7 in a fifth embodiment of the invention. The reconfigurable antenna 7 belongs to the category of bowtie antennas that are capable of frequency switching among a plurality of patterns similarly to the reconfigurable antenna 5 in the fourth embodiment described above. In the reconfigurable antenna 7, a plurality of metal patterns 18*a* to 18*d* are each disposed with space from another, and the contact-point group 10 is provided between each two metal patterns for mechanical driving by drive sections. These metal patterns 18*a* to 18*d* are disposed so as to be symmetrical about the feeding point 12. Note here that any component similar to that in the first and fourth embodiments described above is provided with the same reference numeral, and is not described twice if appropriate.

However, unlike the reconfigurable antenna 5 in the fourth embodiment described above, in the reconfigurable antenna 7 in this embodiment, the metal patterns 18*a* to 18*d* are all shaped like a triangle in planar view, and are disposed so as to be increased in number by degrees from the side of the feeding point 12 along the feeding direction E. To be specific, the metal patterns 18*a* to 18*d* are arranged in four lines in order from the side of the feeding point 12, i.e., the first line includes a piece of metal pattern 18*a*, the second line includes two pieces of metal patterns 18*b*, the third line includes three pieces of metal patterns 18*c*, and the fourth line includes four piece of metal patterns 18*d*. In other words, the nth line from the side of the feeding point 12 (where n is an integer being 1 or larger, and in this example, n is 4 or smaller) includes n pieces of metal patterns.

In these lines of the metal patterns 18*a* to 18*d*, the metal patterns 18*a* to 18*d* are aligned in the same direction, i.e., the vertexes of the triangles are all directed toward the feeding point 12, and are so disposed that the vertexes of one triangle are in close vicinity to those of other triangles. In other words, the three sides of each three of the metal patterns 18*a* to 18*d* form space also in the triangular shape. The metal patterns 18*a* to 18*d* in a regular arrangement as such are provided to be symmetrical about the feeding point 12, and are in the so-called fractal shape as a whole. Note that, in FIG. 20, for convenience, the metal patterns 18*a* to 18*d* are respectively denoted by "A" to "D".

Between such metal patterns 18*a* to 18*d*, the contact-point group 10 is disposed between the vertexes of each two triangles, and are driven on the line basis. To be specific, the contact-point group 10 between the metal patterns 18*a* and 18*b* is driven by the drive section 20A, the contact-point group 10 between the metal patterns 18*b* and 18*c* is driven by the drive section 20B, and the contact-point group 10 between the metal patterns 18*c* and 18*d* is driven by the drive section 20C.

Figure 21A:
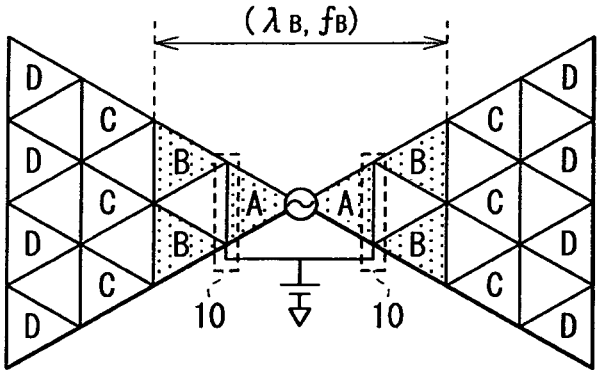
FIGS. 21A to 21C are schematic diagrams for illustrating the operation effects of the reconfigurable antenna of FIG. 20.
Figure 21B:
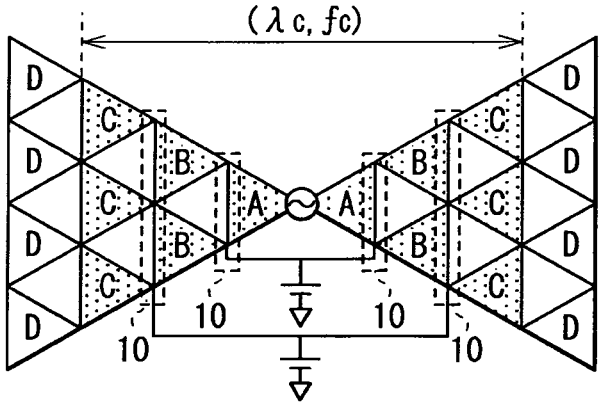
Figure 21C:
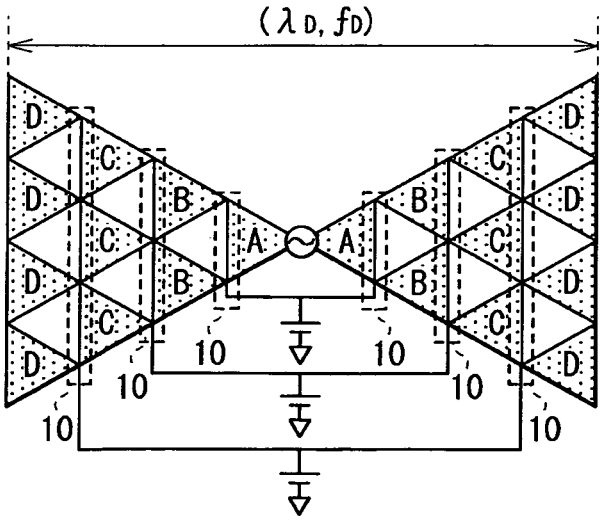

In this embodiment, the metal patterns 18*a* to 18*d* are each disposed with space from another in a predetermined arrangement, and the electrical coupling between these metal patterns 18*a* to 18*d* is mechanically controlled by these contact-point groups 10. In such a reconfigurable antenna, when the metal patterns 18*a* and 18*b* are electrically insulated from each other, only the metal patterns 18*a* in a pair serve as the radiation section, and electromagnetic waves are radiated therefrom at the base frequency of $f_A$ (not shown). On the other hand, when the drive section 20A brings electrical conduction to the metal patterns 18*a* and 18*b*, the region across the metal patterns, i.e., region from the metal pattern 18*a* to the metal pattern 18*b*, serves as the radiation section which radiates electromagnetic waves at the base frequency of $f_B$ (FIG. 21A). Moreover, when the drive section 20B brings electrical conduction to the metal patterns 18*b* and 18*c*, the region across the metal patterns, i.e., region from the metal pattern 18*a* to the metal pattern 18*c*, serves as the radiation section which radiates electromagnetic waves at the base frequency of $f_C$ (FIG. 21B). When the drive section 20C brings electrical conduction to the metal patterns 18*c* and 18*d*, the region across the metal patterns, i.e., region from the metal pattern 18*a* to the metal pattern 18*d*, serves as the radiation section which radiates electromagnetic waves at the base frequency of $f_D$ (FIG. 21C). In other words, the frequency switching can be performed based on four values of frequency, i.e., $f_A$ to $f_D$. As such, the effects similar to those achieved in the first embodiment described above can be achieved.

With the metal patterns 18*a* to 18*d* arranged as such in the fractal shape, the resulting radiation sections can be all similar in shape at the time of frequency switching. This favorably leads to the similar frequency responses in the range of frequencies available for switching. To be specific, the ratio between the center frequency fr and the band width thereof δf, i.e., δf/fr, can remain the same. With a general reconfigurable antenna, the frequency response shows a large change by the frequency switching, but with the reconfigurable antenna 7 in this embodiment, such a change of frequency response is prevented with ease.

Furthermore, with such a layout of the switches 101 as described in the comparison examples 1 and 2, the metal patterns cannot be arranged in a plurality of lines, especially in three or more lines as in the embodiment. This is because, with the reconfigurable antennas in the comparison examples 1 and 2, arranging the metal patterns in three or more lines means placing the switches 101 in the center portion and therearound of the radiation section, and this causes adverse influence to the radiation characteristics due to electromagnetic waves coming from the drive circuit as described above. On the other hand, in this embodiment, the contact-point groups 10 can be electrically insulated from the drive section, and be disposed with space therefrom. This accordingly allows the placement of the contact-point groups 10 in the center portion and therearound of the region serving as the radiation section without reducing the radiation characteristics. To be specific, the contact-point group 10 can be disposed at an inner position between the metal patterns 18*b* and 18*c*, and at two inner positions between the metal patterns 18*c* and 18*d*. As such, with the advantages of the fractal shape offering the satisfactory radiation characteristics, the metal patterns can be arranged in a larger number of lines, and the range of frequencies available for switching can become wider.

While the invention has been described in detail with the embodiments, the foregoing description is in all aspects illustrative and not restrictive. It is understood that numerous other modifications and variations can be devised. For example, the transmission/reception element in the aspect of the invention is exemplified by a reconfigurable antenna that is capable of frequency switching, but alternatively, a reconfigurable antenna that can be controlled in directivity is also possible using the principles of the invention, i.e., change the state of metal patterns by mechanical control. As an example, changing the symmetry of the antenna means controlling the antenna directivity, more specifically, controlling the direction of radiation and the spreading of radiation surface. Alternatively, the antenna can be controlled in terms of sensitivity not by changing the frequency and antenna directivity but based on the effective area of the antenna. This can be realized by controlling the number of antennas effective for use in a patch antenna in which metal patterns are arranged like an array, for example.

The present application contains subject matter related to that disclosed in Japanese Priority Patent Application JP 2010-020371 filed in the Japan Patent Office on Feb. 1, 2010, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A transmission/reception element comprising:

a plurality of metal layers disposed on a substrate and spaced apart from each other;

a switch configured to control electrical coupling between the plurality of metal layers, wherein the switch comprises a contact-point group including a plurality of contact-point pairs each arranged along a movable member disposed in a cavity formed between a pair of the plurality of metal layers; and a drive section coupled to the contact-point group via the movable member and configured to mechanically drive the contact-point group in order to switch a state of each of the plurality of contact-point pairs between in-contact and no-contact, wherein the movable member is coupled to one end of the drive section and configured to slide in a direction along which the contact-point pairs are arranged, wherein the movable member is provided with a plurality of bars at another end, wherein the contact-point pairs are each provided with a fixed contact point provided on each of the plurality of the metal layers, and a movable contact point provided to each of the plurality of bars of the movable member, wherein a wall surface of the cavity is shaped with one or more concavities and one or more convexities to match a shape of the movable member.

2. The transmission/reception element according to claim 1, wherein the drive section is positioned to be electrically insulated from the contact-point group.

3. The transmission/reception element according to claim 1, wherein the drive section is disposed at a region in a plane that is shared with the contact-point group, and outside a region where the plurality of metal layers are disposed.

4. The transmission/reception element according to claim 1, wherein the movable member and the plurality of bars are covered by a metal film in a region corresponding to the contact-point group.

5. The transmission/reception element according to claim 1, wherein the plurality of metal layers and the contact-point group are provided on one side of a dielectric layer, and the other side of the dielectric layer functions as a grounded antenna.

6. The transmission/reception element according to claim 5, wherein each of the plurality of metal layers is made of a thin film.

7. The transmission/reception element according to claim 6, wherein each of the plurality of the metal layers is in a rectangular shape in planar view, wherein each of the plurality of metal layers are disposed along a feeding direction with sides of the plurality of metal layers opposing each other, and wherein the contact-point group is provided between the opposing sides.

8. The transmission/reception element according to claim 1, wherein the drive section collectively drives the contact-point pairs in the contact-point group.

9. The transmission/reception element according to claim 1, wherein the drive section includes a micro-electro-mechanical systems (MEMS) actuator.

10. The transmission/reception element according to claim 9, wherein the MEMS actuator is an electrostatic MEMS actuator operated by lateral driving.

11. The transmission/reception element according to claim 10, wherein the movable member that is coupled to one end of the drive section, wherein the MEMS actuator comprises a fixed electrode and a moving electrode, wherein the moving electrode slides along an operation axis same as that of the movable member.

12. The transmission/reception element according to claim 11, wherein the fixed electrode is fixed to the substrate.

13. The transmission/reception element according to claim 1, wherein a frequency of electromagnetic waves radiated from the transmission/reception element depends on a width of one or more of the plurality of metal layers.

14. The transmission/reception element according to claim 13, wherein an operation of switching the state of each the plurality of contact-point pairs corresponds to a change in the frequency of the electromagnetic waves radiated.

* * * * *